US008453695B2

(12) United States Patent
Ward et al.

(10) Patent No.: US 8,453,695 B2
(45) Date of Patent: Jun. 4, 2013

(54) PORTABLE APPLICATOR

(75) Inventors: Donald J. Ward, Sayre, PA (US); Raymond A. Blanchard, Jr., Dryden, NY (US); Richard E. Roberts, Pine City, NY (US); Monti D. Emery, Elmira, NY (US); Wonnie Brown, Haledon, NJ (US)

(73) Assignee: Avery Dennison Retail Information Services, LLC, Pasadena, CA (US)

( * ) Notice: Subject to any disclaimer, the term of this patent is extended or adjusted under 35 U.S.C. 154(b) by 1563 days.

(21) Appl. No.: 11/590,123

(22) Filed: Oct. 30, 2006

(65) Prior Publication Data

US 2008/0185093 A1 Aug. 7, 2008

(51) Int. Cl.
*B65C 9/18* (2006.01)
*B65C 9/44* (2006.01)

(52) U.S. Cl.
USPC ..... 156/361; 156/378; 156/495; 156/540; 156/580; 156/583.1

(58) Field of Classification Search
None
See application file for complete search history.

(56) References Cited

U.S. PATENT DOCUMENTS 3,813,268 A 5/1974 Kerwin
3,815,456 A * 6/1974 Braathen et al. ..... 83/68
4,577,199 A * 3/1986 Saiki et al. ..... 347/215
4,743,325 A * 5/1988 Miyake ..... 156/250
5,073,223 A * 12/1991 Kurihara ..... 156/362
5,147,495 A * 9/1992 Douglas ..... 156/540
5,954,915 A * 9/1999 Voorhees et al. ..... 156/362
6,264,774 B1 * 7/2001 Lenz et al. ..... 156/64
6,292,207 B1 * 9/2001 Sogabe ..... 347/217
6,688,364 B2 * 2/2004 Simpson ..... 156/540
6,984,013 B2 * 1/2006 Arqullevich et al. ..... 347/19
2006/0130973 A1 * 6/2006 Boyd et al. ..... 156/363
2007/0084547 A1 4/2007 Lane

OTHER PUBLICATIONS 1 set of 9 photos; Applicator for heat transfers; Wiring diagram for TR0203; Spare Parts List for TR0203.
PAXAR Systems Group; Electro-Sealer 7111 Users Manual, Manual Edition 2.0; Jun. 30, 2005; Manual Part No. 701398.
PAXAR Systems Group; Electro-Sealer 7112 TR Users Manual, Manual Edition 4.1; Jan. 7, 2005; Manual Part No. 701397.
PAXAR Systems Group; Electro-Sealer 7112 BR Users Manual, Manual Edition 4.0; Sep. 15, 2004; Manual Part No. 701394.
PAXAR Systems Group; Electro-Sealer 7112 HF Users Manual, Manual Edition 3.0; May 28, 2004; Manual Part No. 701395.

* cited by examiner

*Primary Examiner* — Michael Tolin
(74) *Attorney, Agent, or Firm* — Avery Dennison Retail Information Services, LLC

(57) ABSTRACT

There is disclosed an applicator and method for applying transfers such as heat transfers, decals or labels to transfer-receptive materials. The applicator has a lightweight, T-shaped, sheet metal support or frame having an applicator station. A motorized supply roll unwind and a motorized take-up roll rewind are mounted on the support to hold supply and take-up rolls, to tension the transfer-containing web and to advance the web onto the take-up roll after the transfer has been applied at the applicator station.

35 Claims, 20 Drawing Sheets

PORTABLE APPLICATOR

BACKGROUND OF THE INVENTION

1. Field of the Invention

This application relates to applicators for transfers such as heat transfers and labels.

2. Brief Description of the Prior Art

Prior art applicators for transfers having included heavy, bulky machines that were difficult to carry or transport. Certain applicators had a tendency to lose tautness in the transfer-containing web during operation or during idle conditions which can result in loss of registration.

SUMMARY OF THE INVENTION

It is a feature of an embodiment to provide an improved applicator for transfers that is easy and low-cost to construct, that is portable and compact, is relatively lightweight and easy to carry and transport, and that is reliable in operation. It is preferred that the operative elements of the applicator be mounted on a lightweight sheet metal support having box-like sections or portions that are easy to construct and assemble. It is another feature of the embodiment to control the transfer-containing web to avoid loss of registration by acting on a composite web supply roll and a spent carrier web take-up roll so that the supply roll is continuously driven in a direction to wind the web onto the roll in order to maintain tension in the web while the take-up roll is held stationary. The web is drawn from or paid out of the supply roll by an applicator platen while the applicator platen is being driven into cooperation with a cooperating platen. This eliminates the need to have any auxiliary feed mechanism. The spent carrier web is drawn onto the take-up roll after a transfer has been applied to a transfer-receptive material such as a cloth garment. Advance of the web onto the take-up roll is under the control of registrations marks on the web.

A preferred embodiment of an applicator includes a support, a driven applicator platen on the support, the platen being capable of being heated, a supply roll unwind on the support and capable of holding a supply roll of a composite web comprised of a carrier web and a plurality of transfers releasable adhered to the carrier web, the unwind being motor-driven continuously in a winding direction to tension the composite web, and a take-up roll rewind on the support to accumulate spent carrier web onto a take-up roll, the carrier web being movable in a travel direction, with the composite web being unwound from the supply roll to pass into transfer-applying relationship with the applicator platen and onto the take-up roll, and the take-up roll being driven by the rewind only when required to advance the spent carrier web onto the take-up roll. It is preferred that the supply roll unwind and the take-up roll rewind are the sole means to maintain the carrier web under tension and to advance the carrier web.

A preferred method of applying transfers includes providing, a pair of platens movable relative to each other, one of the platens being capable of supporting transfer-receptive material, providing a supply roll of a composite web comprised of a carrier web and a plurality of transfers releasably adhered to the carrier web, the carrier web being capable of passing from the supply roll to between the platens and to a take-up roll, continuously applying force to the supply roll tending to wind the composite web onto the supply roll to tension the carrier web, moving one of the platens relatively into cooperation with the other platen to apply a transfer from the composite web onto the transfer-receptive material while the movable platen pulls the composite web from the supply roll, and thereafter advancing the spent composite web to the take-up roll while overcoming the force exerted on the carrier web by the supply roll.

A preferred method of applying transfers includes providing a composite web comprised a carrier web and a plurality of transfers releasable adhered to the carrier web, providing an applicator station where transfers are capable of being applied to transfer-receiving material during a transfer-applying cycle, positioning the composite web to pass along a travel path from upstream of the applicator station, through the applicator station and to downstream of the applicator station, continuously exerting a first pulling force in the upstream direction on the composite web, applying a transfer from the composite web to the transfer-receiving material at the transfer station during a transfer applying cycle, and exerting a second pulling force greater than the first pulling force in the downstream direction on the carrier web after a transfer has been applied during a cycle to advance the composite web to a position in which another transfer can be applied during the next cycle. It is preferred that the first and second pulling forces are the sole means to tension and advance the carrier web.

A preferred method of applying transfers, includes providing a composite web comprised a carrier web and a plurality of transfers releasable adhered to the carrier web, providing an applicator station where transfers are capable of being applied to transfer-receiving material during a transfer-applying cycle, positioning the composite web to pass along a travel path from upstream of the applicator station, through the applicator station and to downstream of the applicator station, continuously exerting a first pulling force in the upstream direction on the composite web, applying a transfer from the composite web to the transfer-receiving material at the applicator station during a transfer-applying cycle, energizing a motor to prevent the carrier web from advancing at least until a transfer has been applied, and thereafter energizing the motor to exert a second pulling force in the downstream direction greater than the first pulling force in the downstream direction on the carrier web to advance the composite web to a position in which another transfer can be applied during the next cycle.

A preferred method of applying transfers, includes providing a movable transfer-applying platen, providing a supply roll of a composite web comprised of a carrier web and a plurality of transfers releasably adhered to the carrier web, positioning the composite web in transfer-applying relationship to the platen, preventing the carrier web from advancing until after a transfer has been applied, continuously driving the supply roll in a direction to attempt to wind the composite web onto the supply roll to maintain tension in the carrier web, and paying out the composite web under tension from the supply roll in response to movement of the platen to apply a transfer to transfer-receiving material.

A preferred method of applying a transfer includes providing a composite web comprised of a carrier web and a plurality of transfers releasably adhered to the carrier web, the carrier web extending along a path between a supply roll and a take-up roll, the path crossing a platen, maintaining the take-up roll in a first position, urging the supply roll in a first rotational direction with a first force, the force being insufficient to change the position of the take-up roll, translating the platen from a first position to a second position, the translation causing the composite web to be unwound from the supply roll, translating the platen back toward the first position, and rotating the take-up roll in a second rotational direction, the rotating causing the carrier web to be wound onto the take-up roll. The first and second rotational directions can be the same or opposite each other. The translating of the platen from the first to the second position can include urging the supply roll in the first rotational direction with a second force different than the first force. One method can include receiving a signal from a sensor, the signal indicating that the carrier web had been sufficiently translated along the path. The rotating of the take-up roll can cause the carrier web to translate with respect to at least two direction-changing guides.

A preferred embodiment of an applicator includes an applicator, a support including an upstanding portion, the upstanding portion having a pair of spaced sheet metal side panels generally shaped like the letter C, a generally horizontal plate connecting the side panels at the upper part of the C, a piston-cylinder mechanism having a cylinder-mounted to the horizontal plate, and a piston operating in a cylinder, an upper platen connected to the piston, and a lower platen at the lower part of the C and cooperable with the upper platen. It is preferred that the support includes a support portion for a supply web roll attached to one side panel and another support portion for a web take-up roll, and wherein the support portions are comprised of sheet metal and are box-shaped.

BRIEF DESCRIPTION OF THE DIAGRAMMATIC DRAWINGS

DETAILED DESCRIPTION OF THE PREFERRED EMBODIMENTS

Figure 1:
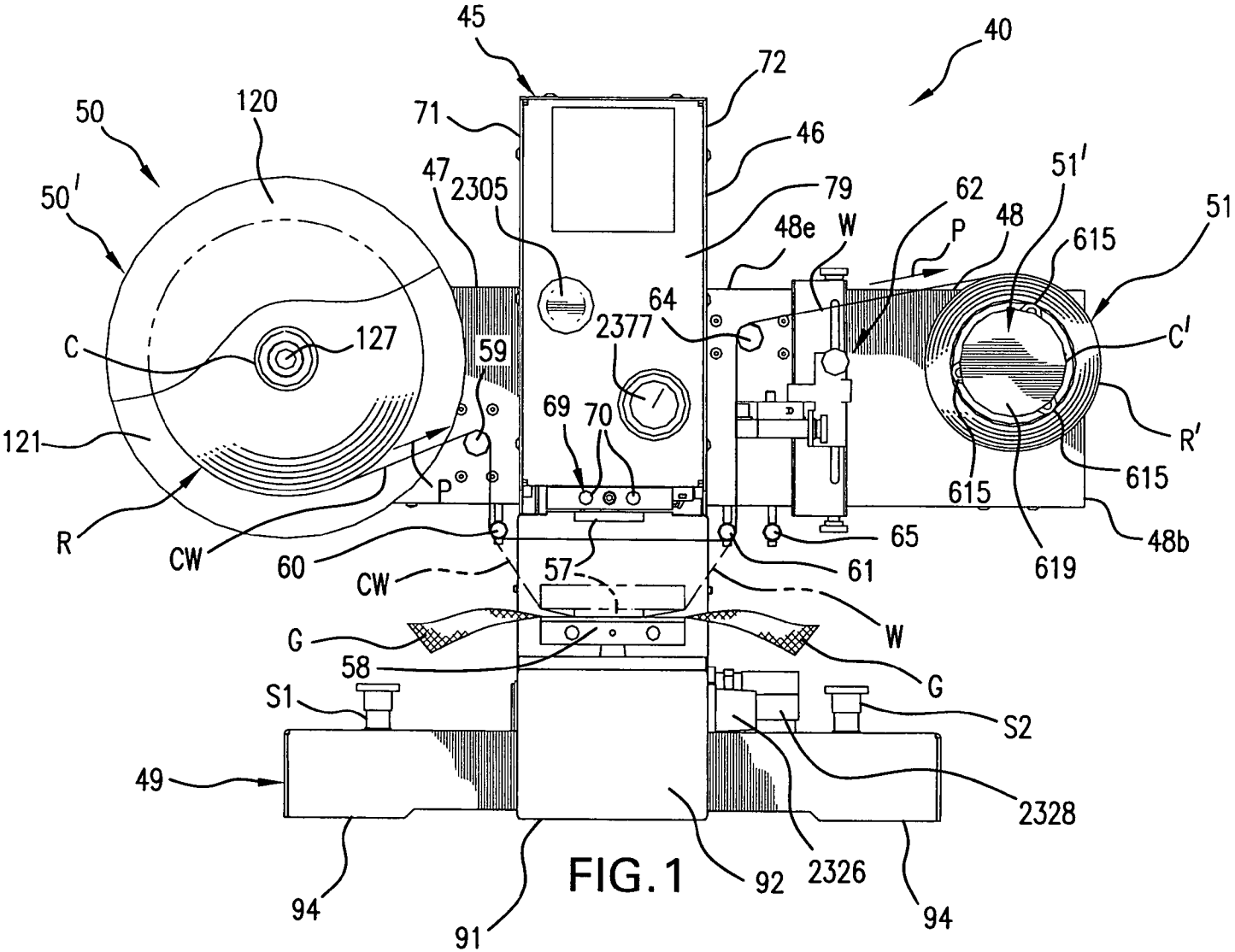
FIG. 1 is a front elevational view of an embodiment of an applicator for applying transfers to transfer-receptive materials.
Figure 2:
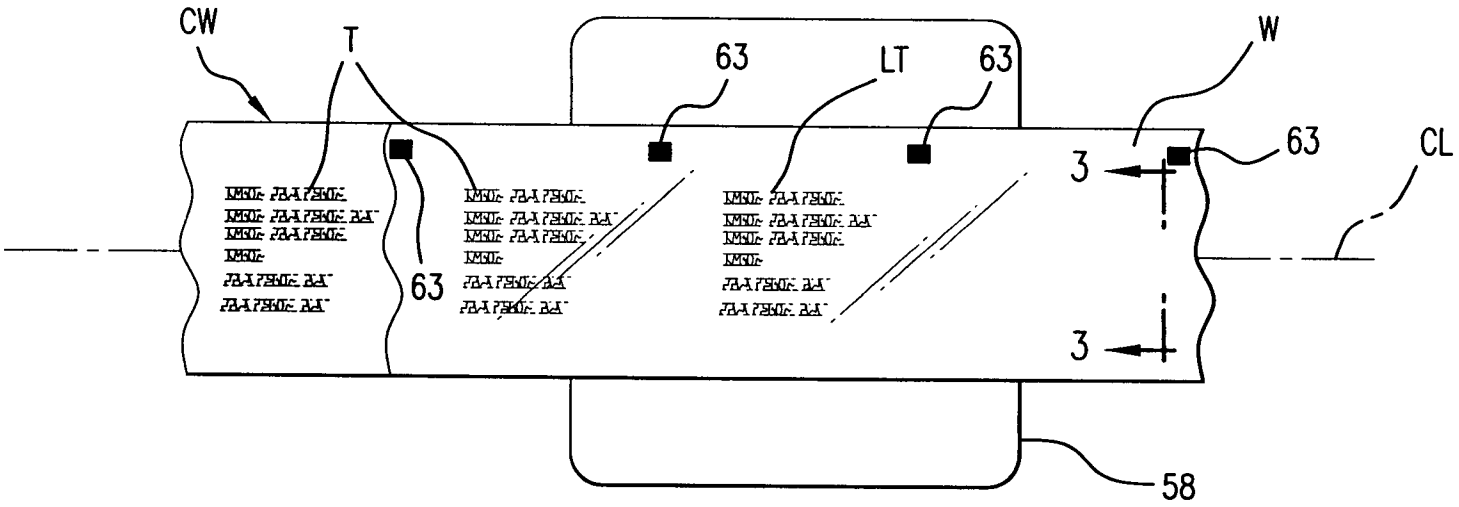
FIG. 2 is a top plan view of a fragmentary portion of a composite web containing transfers releasably adhered to a carrier web and supported by a platen.
Figure 3:
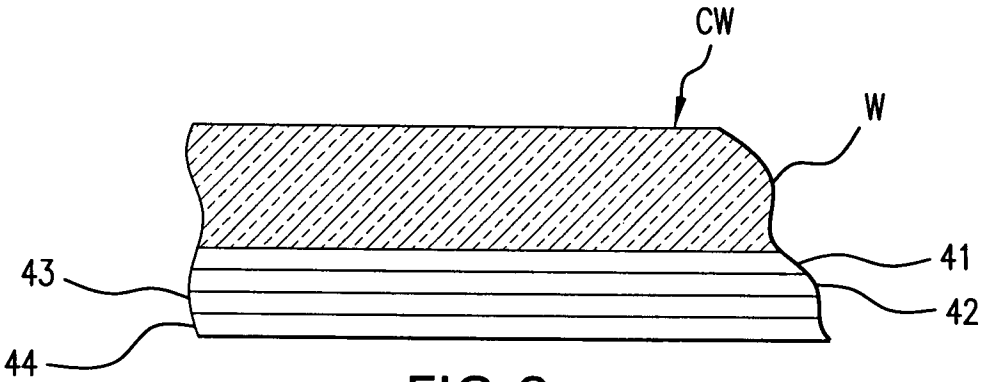
FIG. 3 is an enlarged cross-sectional view taken generally along line 3-3 of the composite web of FIG. 2.

With reference initially to FIGS. 1 through 3, there is shown an applicator generally indicated at 40 for applying transfers T to transfer-receptive material G such as garments or other suitable substrates. The applicator 40 is portable so that it can be carried from place-to-place by one person and can be shipped by common carrier without elaborate crating or packaging. A composite web CW is shown as being in a supply roll which may typically have a central core C. The composite web CW is comprised of a carrier web W to which the transfers T are releasably adhered. The carrier web W is preferably comprised of a transparent plastics film, but it may be comprised of translucent or opaque materials such as paper or the like. The carrier web W is coated with a release material such as silicone or other suitable materials. The transfers T can be heat transfers as illustrated, or they can be decals, heat seal labels, pressure sensitive labels or the like. The illustrated transfers T are heat transfers which are typically applied to the transfer-receptacle material G preferably using heat and pressure. The carrier web W is typically coated with a continuous release coating 41 (FIG. 3). It is preferred to have a transparent protective coating 42 applied to the release coating 41, and for printing 43 to be applied to the protective coating 42. A continuous coating of a non-tacky adhesive 44 is applied over the protective coatings 42 and the printing 43. Further details of heat transfers (also known as thermal transfers) are disclosed in co-owned U.S. Pat. No. 7,102,657, the disclosure of which is incorporated by reference in its entirety.

With references to FIG. 1, the applicator 40 is shown to include a support generally indicated at 45. The support 45 includes a central, upstanding portion 46 joining support portions, specifically side portions 47 and 48. The support portions 47 and 48 are generally aligned and are positioned on opposite sides of the upstanding portion 46. The support 45 is in a generally T-shaped arrangement with the side portions 47 and 48 comprising arms. The support 45 also includes a base member or stabilizer generally indicated at 49 to enhance side-to-side stability. The side portion 47 mounts a supply roll unwind generally indicated at 50 for a supply roll R, and the side portion 48 mounts a take-up roll rewind generally indicated at 51 for a take-up roll R'. The unwind 50 includes a supply roll holder 50' and the rewind 51 includes a rewind roll holder 51'. The upstanding portion 46 mounts an actuator 52 for example an air motor or a piston-cylinder mechanism (FIGS. 4 and 6) which includes a cylinder 53 and a piston 54 (FIGS. 6 and 23) slidably received in the cylinder 53. A piston rod 56 moved by the piston 54 is coupled to an upper platen 57. FIG. 1 shows the upper platen 57 in the home or raised position in solid lines and in a lowered or transfer-applying position in phantom lines. In the home position, the platen 57 is spaced above the composite web CW. The upper platen 57 is cooperable with a lower platen 58 in the transfer-applying position. As shown, the transfer-receptive material G such as a garment, is laid over and rests on the lower platen 58 and there is substantial space above the lower platen 58 for the material G to be easily inserted beneath the composite web CW without the user's hands or the material G contacting the composite web CW. It is noted that the actuator 52, the upper platen 57 and the lower platen 58 together comprise main portions of an applicator station A housed by the upstanding portion 46. It is preferred that the upper platen 57 move or travel relative to the lower platen 58. This relative movement is preferred in that it is simple and user-friendly. However, it is contemplated that the lower platen 58 can translate toward and away from the upper platen or that both the upper platen and the lower platen move toward and away from each other (by constructions not shown). While an air motor is illustrated other types of motors such as an electric motor (not shown) or a hydraulic motor (not shown) are within the scope of the invention.

FIG. 1 shows the travel direction or path P of the carrier web W in the applicator 40. The composite web CW is shown extending out from the lower surface of the supply roll R and can pass over and partly around a direction-changing guide preferably a roll 59. From there the composite web CW can pass partly around and under a direction-changing guide 60 which is mounted to the underside of the side portion 47. From there the composite web CW passes horizontally beneath the upper platen 57. A transfer T is applied at the transfer-applying station A and the spent carrier web passes under and partly around a direction-changing guide 61. The upstanding portion 45 is disposed at the transfer-applying or applicator station A where transfers are successively applied to the transfer-receptive material G. As the upper platen 57 translates toward the lower platen 58, the platen 57 contacts the tensioned composite web CW and draws composite web CW from the roll R to bring the leading transfer LR (FIG. 2) into transfer-applying relationship with respect to the material G and the lower platen 58. Once transfer LT has been transferred onto the material G, the spent carrier web W devoid of transfers can pass about the guide 61 and generally vertically to a sensor assembly 62 and from there over and partially around a direction-changing guide preferably a roll 64. From there carrier web W can pass to and accumulate on the take-up roll R'. This arrangement is used when the carrier web W has spaced registration marks 63 on its upper surface as shown in FIG. 2 and the carrier web W is opaque or not translucent enough to be sensed through the carrier web W. When the registration marks 63 are on the lower surface of the carrier web W, the carrier web W is passed vertically downward in front of the sensor assembly 62 after passing partially about the roll 64 and from there the carrier web W passes partially around and under a direction-changing guide 65. From there the carrier web W is wound onto the outer surface of the take-up roll R'. If the carrier web W is transparent, however, the sensor assembly 62 can sense the registration marks 63 either on one side of the web W or through the web W irrespective of the threading of the carrier web W.

In the embodiment shown in FIG. 1, the roll R has been wound transfer-side-out, so that as the composite web CW is paid out of the roll R, the transfers T are on the underside of the carrier web W. If it were desired to wind the roll R during manufacture transfer-side-in, then the composite web CW would be paid out of the top of the roll R before it passed under the guide 60 and consequently the roll R would be driven counterclockwise as viewed in FIG. 1.

Figure 4:
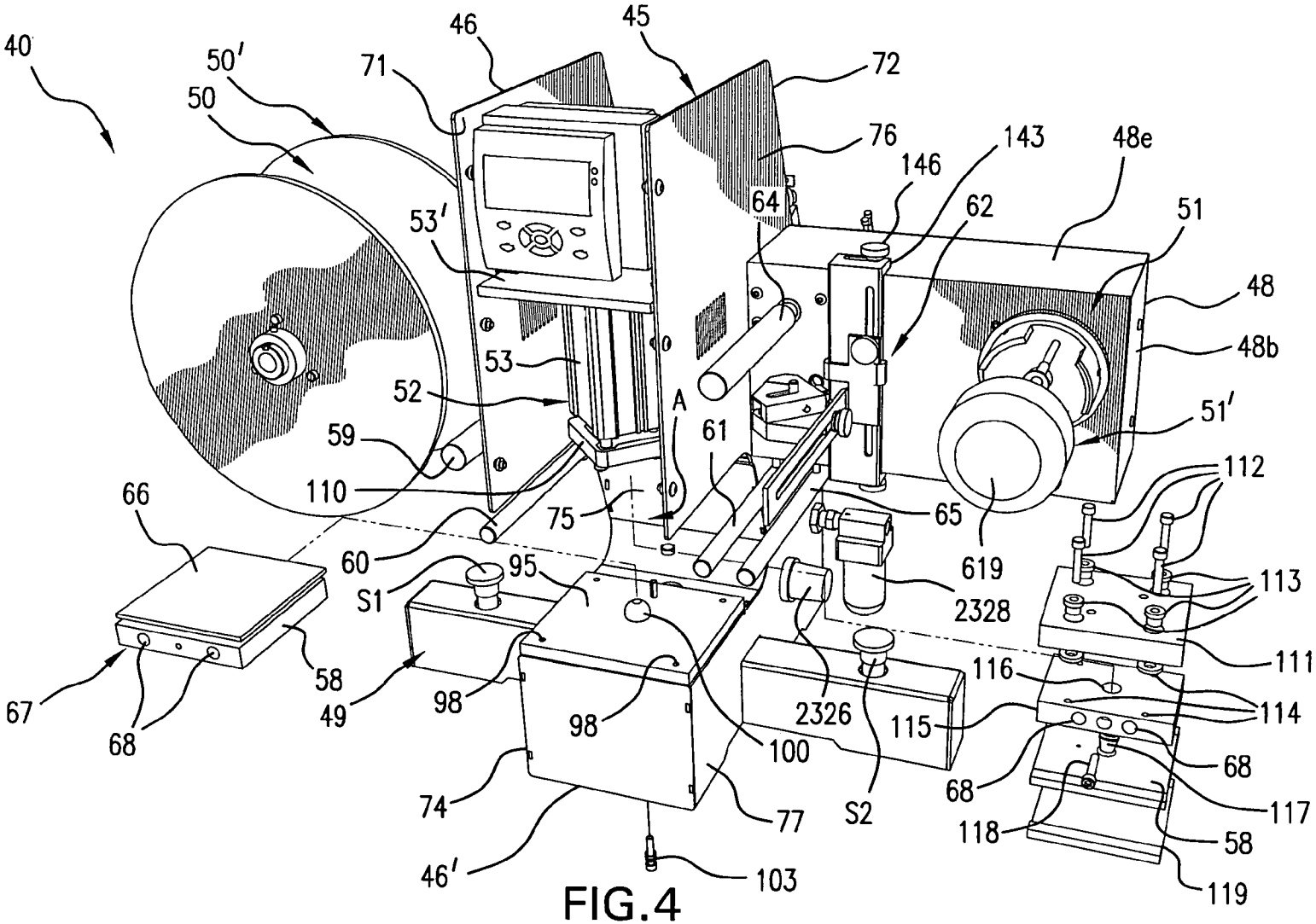
FIG. 4 is a pictorial view of the applicator shown in FIG. 1.
Figure 5:
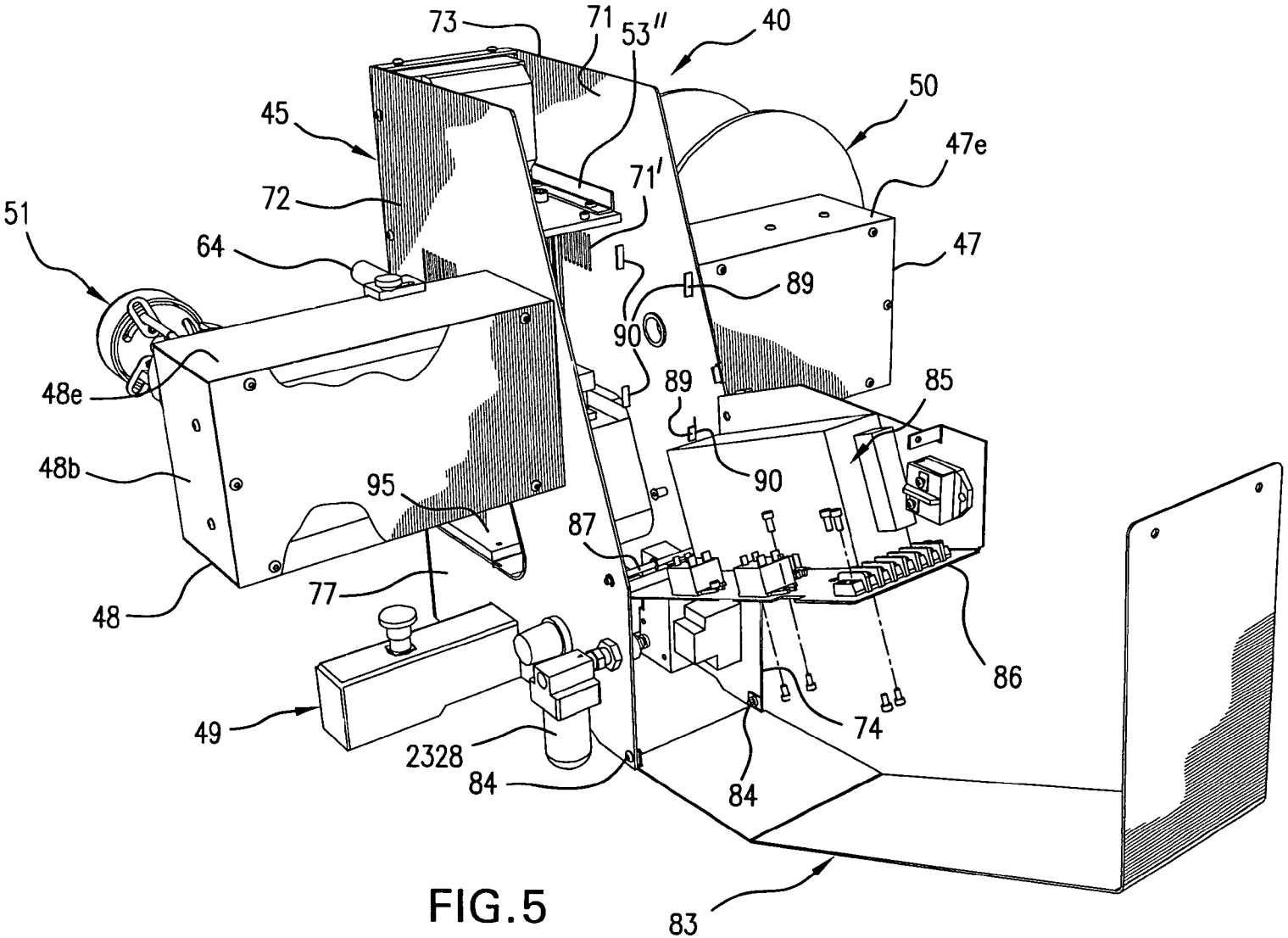
FIG. 5 is a pictorial view of the rear of the applicator also shown in FIGS. 1 and 4 with an access door pivoted open and with a component panel pivoted to an open position.

FIG. 2 shows a top view looking down on the composite web CW and the lower platen 58 without showing any transfer-receiving material, and shows the composite web CW center-justified and centered longitudinally with respect to the platen 58, and thus center-justified with respect to the platen 57. The lower platen 58 accommodates the largest transfer T, although small transfers T, as shown, can be applied. The upper platen 57 is sized to be just marginally larger than the transfer T so that the heat and pressure applied is essentially limited to the shape of the transfer T. In this way heat from the platen 57 and heat, if any, from the lower platen 58 is not applied to the material G essentially beyond the boundaries of the transfer T. The lower platen 58 can have a thin sheet of cushioning material 66 such as rubber or plastics (FIG. 4). The platen 58 can have a heater 67 comprised preferably of a plurality of heater elements 68 and likewise the upper platen 57 can have a heater 69 comprised preferably of a plurality of heater elements 70. It is preferred that the upper platen 57 be heated, and for certain materials it may be desirable for the lower platen 58 also to be heated. In the event both of the platens 57 and 58 are heated, the temperature of the platens 57 and 58 maintained by the heaters 67 and 69 can be different, for example, the upper platen 57 can be maintained at a higher temperature than the lower platen 58 as is preferred, or vice versa.

Figure 6:
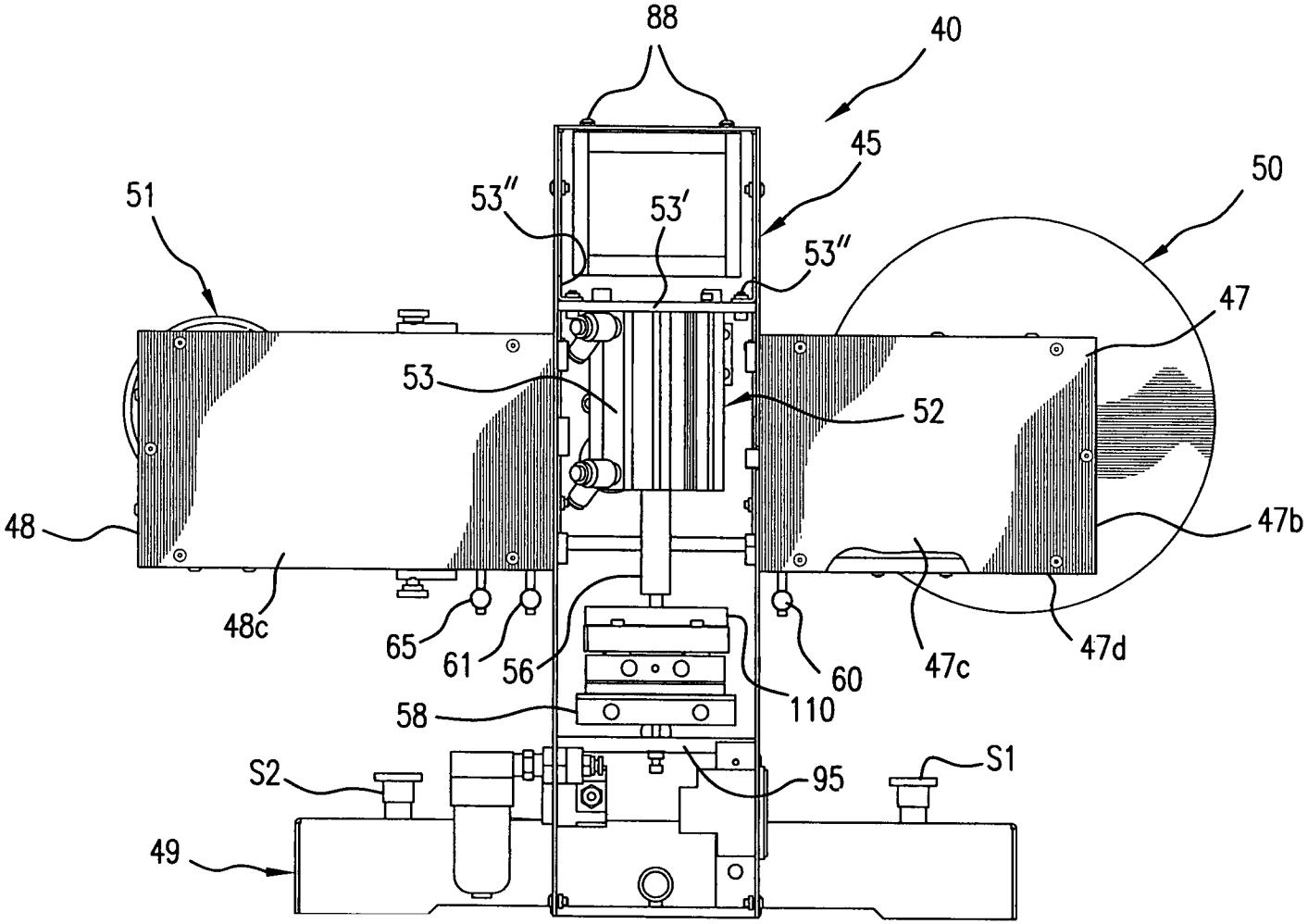
FIG. 6 is a rear elevational, partly broken away view of the applicator also shown in FIGS. 1, 4 and 5.
Figure 7:
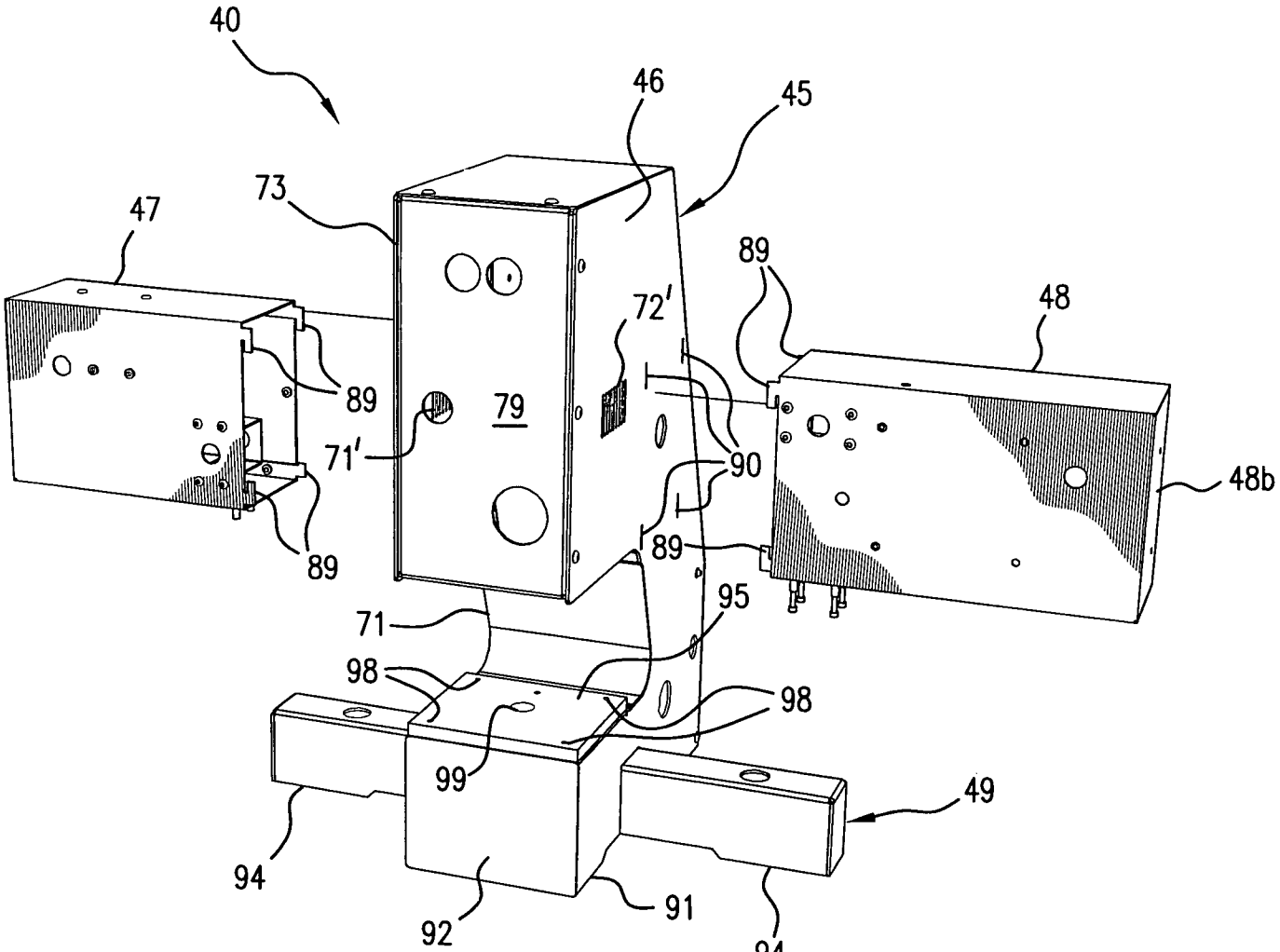
FIG. 7 is a partially exploded pictorial view of a support forming part of the applicator.
Figure 8:
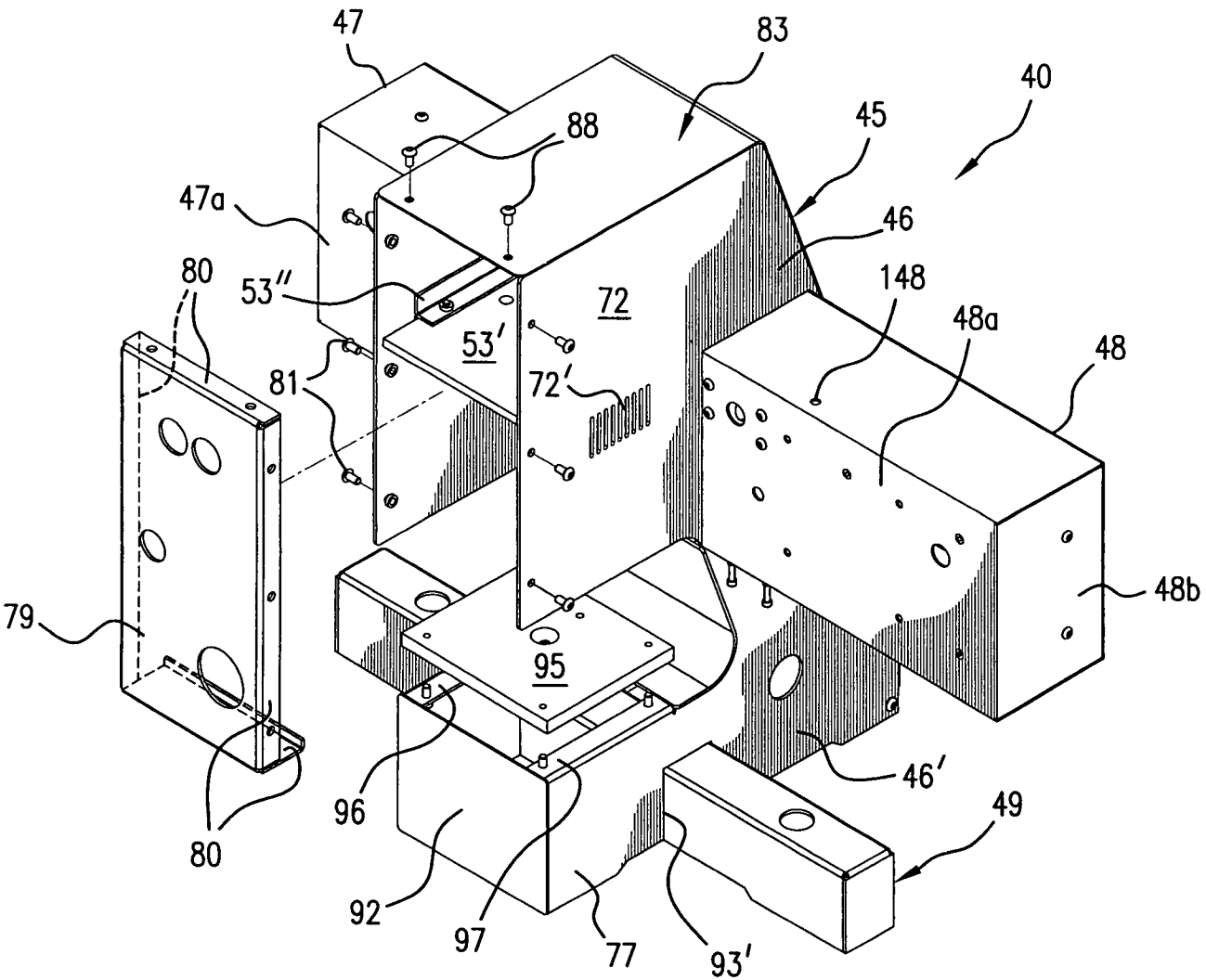
FIG. 8 is another partially exploded pictorial view of the support.

With reference to FIGS. 1 and 4 through 10, the support 45 can be referred to more specifically as a frame, housing or chassis. The support 45 provides a rigid structure comprised preferably essentially entirely of sheet metal such as galvanized steel which is fabricated by cutting and/or bending and can be keyed, screwed or welded together rather than relying mainly on heavy castings, standards, columns, welded steel plates or the like used in prior art applicators. By making the support light in weight, yet with rigidity and structural stability, the entire applicator 40 is light enough in weight to be portable. The box-like or box-shaped upstanding portion 46 of the support 45 has sheet metal side panels 71 and 72 each having a generally C-shaped configuration as shown in FIGS. 4 and 7, for example. The panels 71 and 72 are preferably identical except for certain flanges. The panels 71 and 72 are shown to have air vents 71' and 72' (FIG. 7). The panel 71 has an upper portion 73 and a lower portion 74 joined by a bight or connecting portion 75. Likewise, the panel 72 has an upper portion 76, a lower portion 77 and a bight or connecting portion 78. The lower portions 74 and 77 provide a base 46'. With reference to FIG. 8, a sheet metal front panel 79 is formed by bending to provide four flanges 80. Two of the flanges 80 are secured to the panels 71 and 72 by threaded fasteners 81. A one-piece top and back, sheet metal, generally L-shaped panel generally indicated at 83 (FIGS. 5, 8 and 9, for example) is pivotally mounted on pivot screws 84 to the lower portions 74 and 77 of the panels 71 and 72. The panel 83 provides an access door to enable access to the control components generally indicated at 85 in FIG. 5. The control components 85 such as power supply, a connector board, and so on are mounted on an L-shaped sheet metal panel 86 pivoted on a rod 87. So not only is the component panel 86 readily accessible when the panel 83 has been pivoted from the closed position (FIG. 8) to the open position (FIG. 5), but because the panel 86 pivots outward to an open position from its position between side panels 71 and 12, the components 85 are readily accessible. The panel 83 is secured to the flange 82 (FIG. 8) by threaded fasteners 88 (FIGS. 6 and 8).

Figure 9:
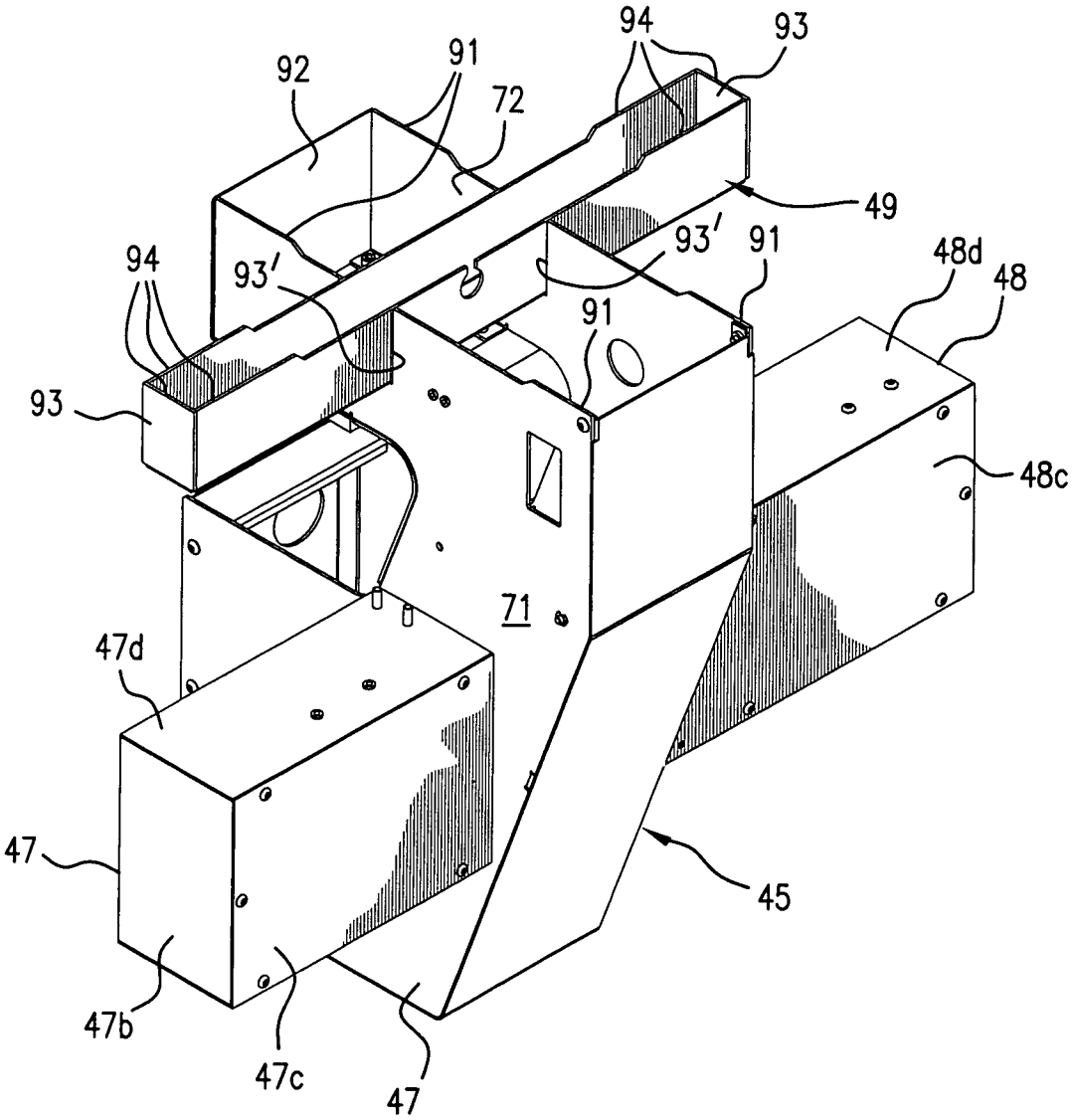
FIG. 9 is a bottom pictorial view of the support.
Figure 10:
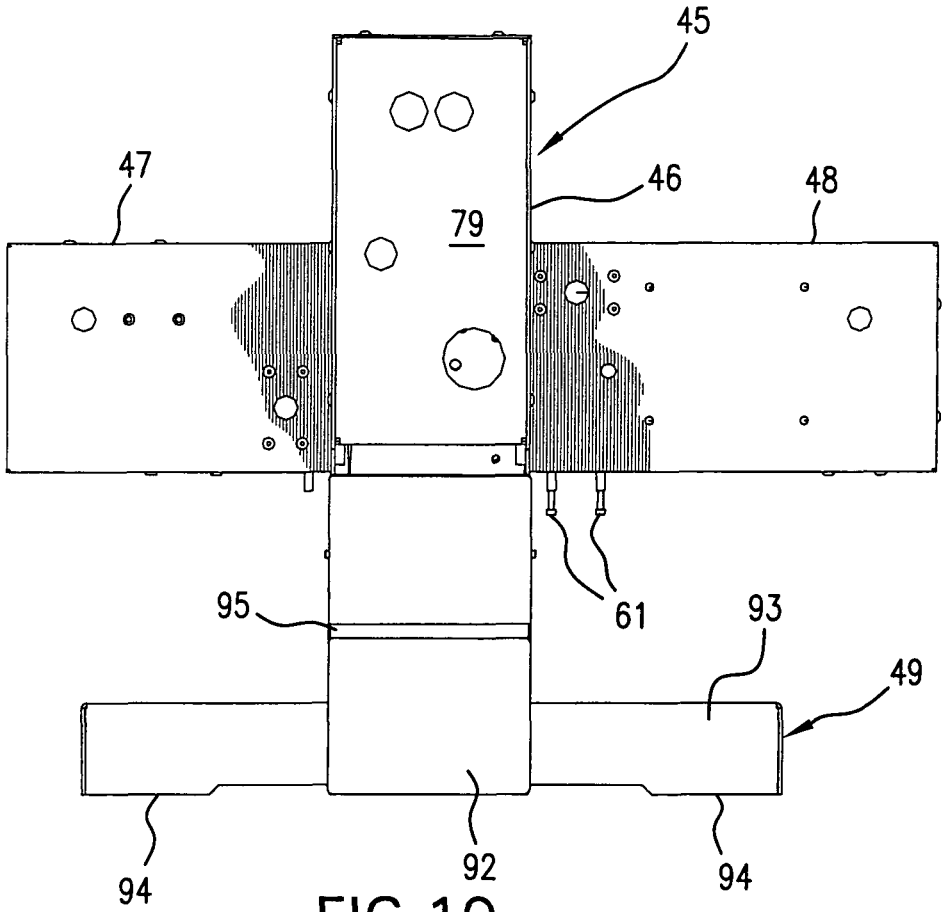
FIG. 10 is a rear elevational view of the support.

The support 45 is preferably T-shaped, and the side portions 47 and 48 comprise arms. The side portion 47 has a front panel 47*a*, a side panel 47*b*, and rear panel 47*c*, a bottom panel 47*d* and a top panel 74*e* in a box-like or box-shaped configuration wherein the side opposite the panel 47*b* can be open as shown for connection to the upstanding portion 46. The panel 47*b* adds stability and rigidity to the side portion 47. Likewise, the side portion 48 has a front panel 48*a*, a side panel 48*b*, a rear panel 48*c*, a bottom panel 48*d* and a top panel 48*e* in a box-like or box-shaped configuration wherein the side opposite the panel 48*b* can be open as shown for connection to the upstanding portion 46. The panel 48*b* adds stability and rigidity to the side portion 48. The side portions 47 and 48 are essentially the same in construction except the side portion 48 is longer than the side portion 47 and except for various holes for fasteners, wiring, and the like. Each side portion 47 and 48 has four bendable tabs 89 (FIGS. 5 and 7) received in vertical slots 90. Once the tabs 89 have been inserted through the aligned respective slots 90 in the upper portions 73 and 76 of the panels 71 and 72, the tabs 89 are bent, thereby keying or locking the side portions 47 and 48 to the upstanding or central portion 46. As shown, for example, in FIG. 9, the lower or base portions 74 and 77 terminate in feet 91. A front plate 92 is preferably welded to the panels 46 and 47 at the lower portions 74 and 77. The feet 91 on panel 71 are spaced from the feet 91 on the panel 72 from one side to the other side of the applicator 40 and the feet 91 are spaced to an even greater extent from the front to the back of the applicator 40. Accordingly, the upstanding portion 46 of the support 45 alone affords good front-to-back stability when the applicator 40 rests on a flat surface of a table or bench. In order to enhance the side-to-side stability of the applicator 40, the sheet metal channel-shaped stabilizer or base member 49 is provided. The lower portions 74 and 77 of the panels 71 and 72 are cut out or notched as to provide inverted U-shaped cutouts or openings 93'. The base member 49 is shown in FIG. 9 to be channel-shaped with closed end portions 93 and extends through the openings 93' and beyond on both sides of the upstanding portion 46. The base member 49 has feet 94 which are coplanar with the feet 91. The feet 94 are spaced substantially from the upstanding portion 46.

The cylinder 53 is mounted to a horizontal plate 53' which is shown to span the distance between, and to be attached to, the side panels 71 and 72. Horizontal brackets 53" are secured by fasteners to the panels 71 and 72. The plate 53' takes the force of the actuator 52 as does the plate 95. The plates 53' and 95 are preferably steel plates heavy enough to absorb the forces applied to them.

With reference to FIGS. 4, 7, 8 and 16, a plate 95 is secured to bent portions or flanges 96 and 97 of the panels 71 and 72 by threaded fasteners 98. The plate 95 has a concave spherical recess 99 and receives a ball-shaped bearing 100. The lower platen 58 also has a concave spherical recess 101 which also receives the bearing 100. The shapes of the recesses 99 and 101 match the outer shape of the bearing 100. An oversize through-hole 102 passes through the bearing 100. A pin or screw 103 receives a compression spring 104 and has a threaded portion 105 threaded into the lower platen 58. The spring 104 is partially loaded and bears against the plate 95 and head 103' of the screw 103. The screw 103 in the oversize hole 102 enables the platen 58 to cant a limited amount in any plane to accommodate for any variations between the upper platen 57 and the lower platen 58 and to accommodate for variations in the transfer-receiving material G. A pin 106 press-fitted into a hole 107 is loosely received in an oversize hole 108 in the platen 58. There is enough clearance between the pin 106 and the inside of the hole 108 to enable the platen 58 to cant to the full extent permitted by the loose fit between the pin 103 and the hole 102, but prevents rotation of the platen 58 except to the small limited amount permitted by the clearance between the pin 106 and the hole 108. The platen 58 is part of a platen assembly generally indicated at 109.

With reference to FIGS. 4 and 6, the piston rod 56 is attached to a plate 110. A heat insulator plate 111 is secured to the plate 110. Screws 112 passing through sleeve-like stand-offs, 113 and the plate 111 are threadably received in holes 114 in a, preferably aluminum, heater plate 115. The plate 115 has a central hole 116 to receive a tapered pin 117 secured in the hole 116 by a screw 118. The pin 117 is secured to the lower platen 58. A thin sheet 119 of tetrafluoroethylene (known under the trademark TEFLON) underlies the plate 58 and is wrapped around beveled front and rear edges thereof. It is the sheet 119 that contacts the composite web CW when the transfer T is being applied.

Figure 12:
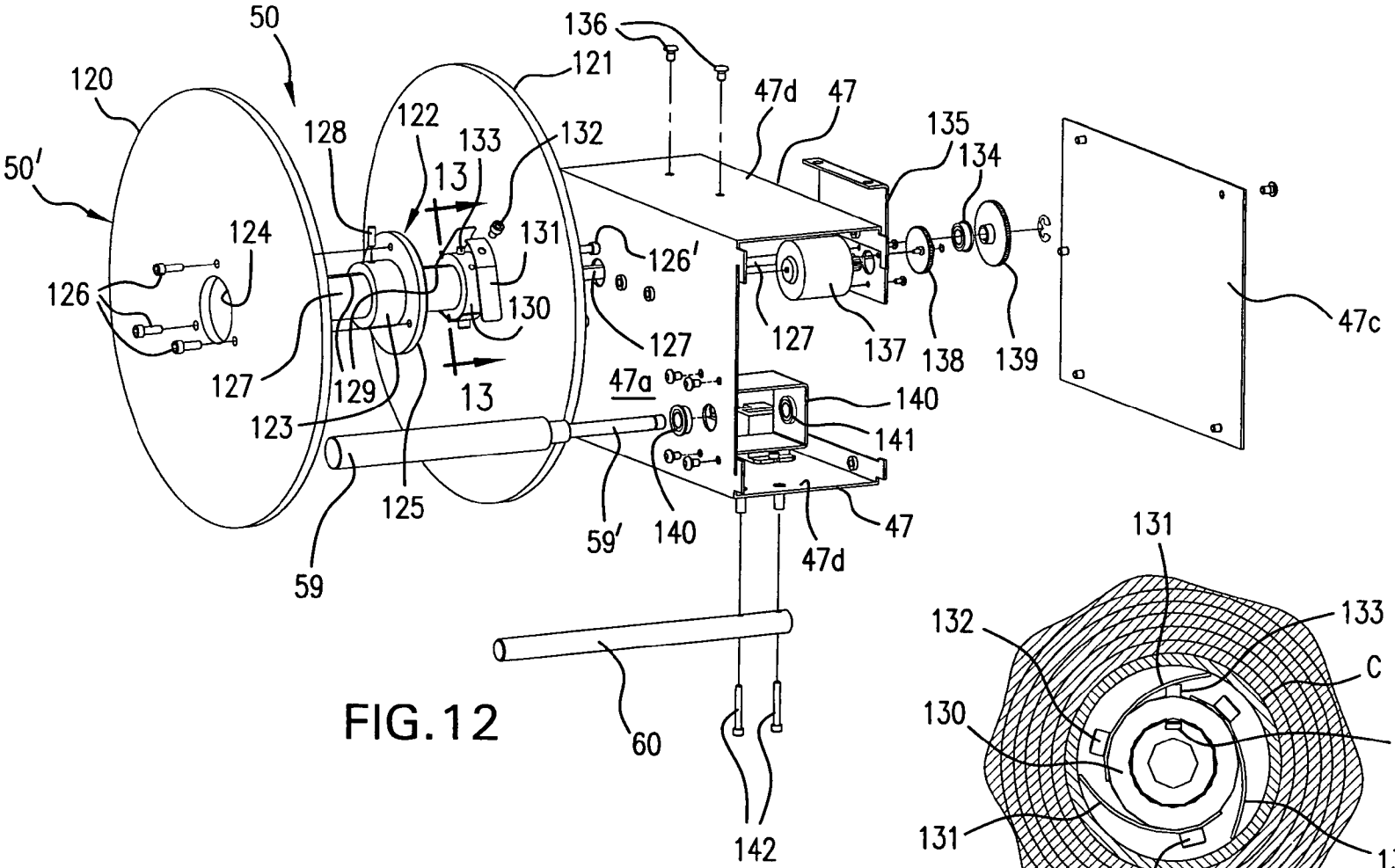
FIG. 12 is an exploded pictorial view of a supply roll unwind.
Figure 13:
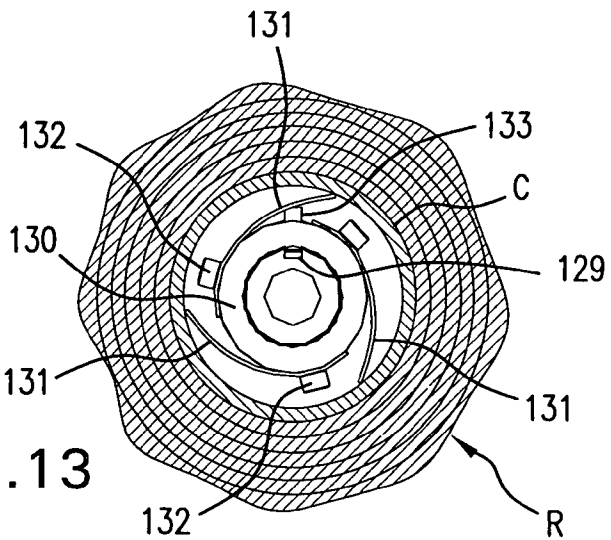
FIG. 13 is a fragmentary cross-sectional view taken generally along line 13-13 of FIG. 12.

With reference to FIGS. 12 and 13, there is shown the motorized supply roll unwind 50. The unwind 50 includes the supply roll holder 50' having a pair of spaced, preferably transparent side plates 120 and 121 between which the supply roll R is mounted. The supply roll R typically has a card-board core C on which the composite web CW is wound. A hub 122 has a hub portion 123 which passes through a hole 124 in the side plate 120 and a core-supporting portion 125 secured coaxially to the side plate 120 by screws 126. The hub 122 is slidably mounted on a drive shaft 127 and is removable from the shaft 127 along with side plate 120. A pin 128 received in the hub portion 123 extends into a groove or keyway 129 in the shaft 127. A hub 130 on the shaft 127 secured to the side plate 121 by screws 126' mounts three flexible resilient tines or prongs 131. The hub 130 and the side plate 121 are also removable from the shaft 127. The tines 131 are secured to the hub 130 by screws 132. The tines 131 are slightly flexed in FIG. 13 from their free state and are effective to frictionally engage and serve as grippers that grip the inside of the core C as the supply roll R is driven in the clockwise direction as viewed in FIGS. 12 and 13. A pin 133 mounted on the hub 130 extends into the groove 129. The side plates 120 and 121 are movable or slidable axially on the shaft 127 and the pins 128 and 133 in the slot 129 prevent relative rotation of the side plates 120 and 121 with respect to the shaft 127. To mount the supply roll R onto the supply roll holder 50' of the unwind 50, the side plate 120 together with its hub 122 are slid off the shaft 127, and the supply roll R can then be positioned onto the tines 131 by rotating the roll R clockwise relative to the hub 130 and its tines 131 and pushing the core C over the tines 131. With the roll R in place, the side plate 120 and its hub 122 can be slid into place against the side of the roll R. Thus, the side plates 120 and 121 and the supply roll R can be positioned manually as a unit along the shaft 127 by visual inspection into center-justified alignment with the centerline CL of the lower platen 58 and the upper platen 57.

The shaft 127 is mounted in bearings 134, only one of which is shown, received in panel 47*a* and a plate 135. The plate 135 is secured to the underside of the panel 47*e* by threaded fasteners 136. The plate 135 also mounts a DC motor 137 which drives the shaft 127 through gears 138 and 139. The panel 47*a* also rotatably mounts the roll 59 in a bearing 140. A stand-off 141 secured to the panel mounts a bearing 141 which in turn mounts a reduced portion 59' of the shaft 59. The guide 60 is secured to the panel 47*d* by screws 142. Except for the shaft 127, bearing 134, gears 138 and 139, the motor 137, the shaft portion 59', the standoff, 140 and the bearing 141, the side portion is hollow.

Figure 14:
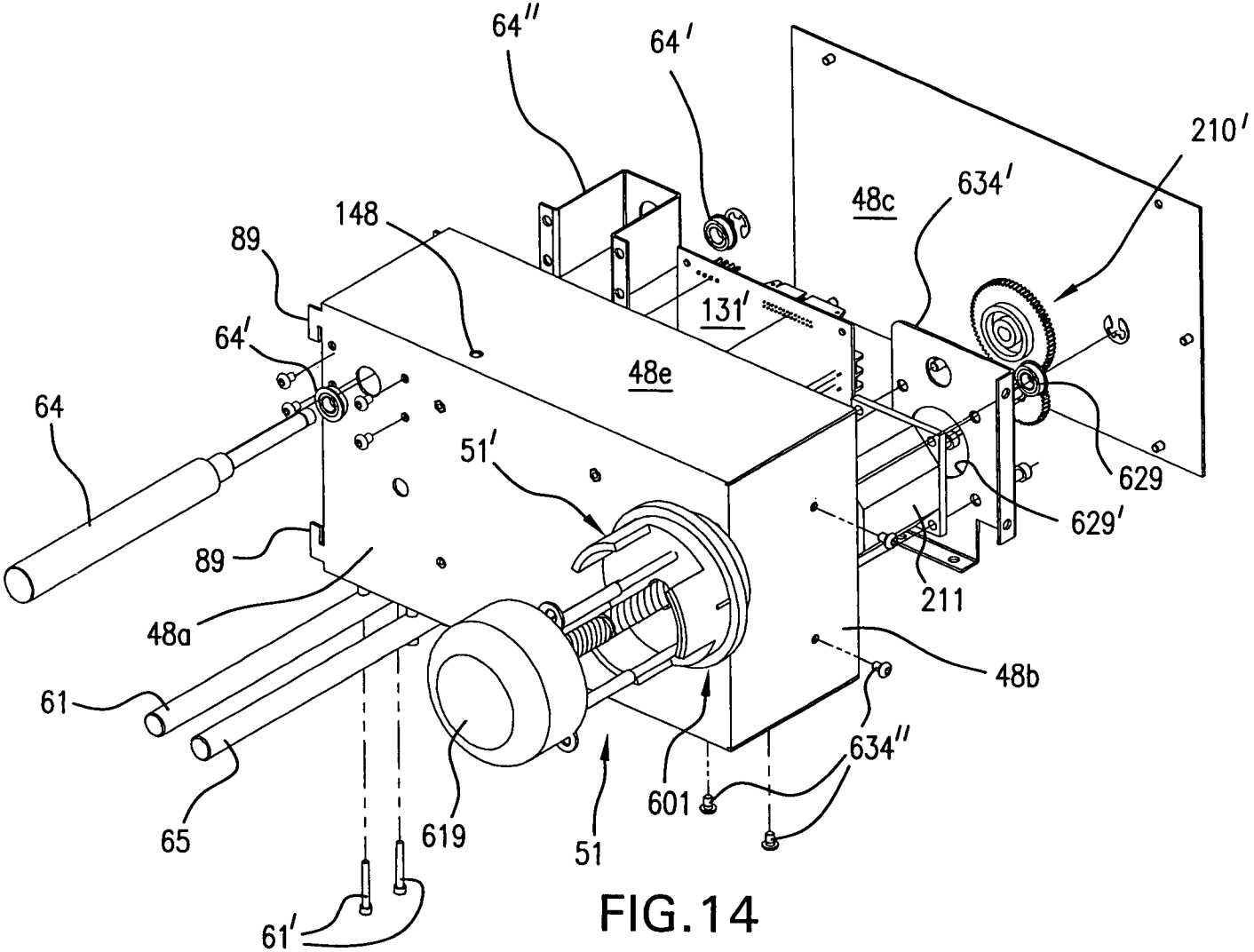
FIG. 14 is an exploded pictorial view of a take-up roll rewind and a support portion.
Figure 15:
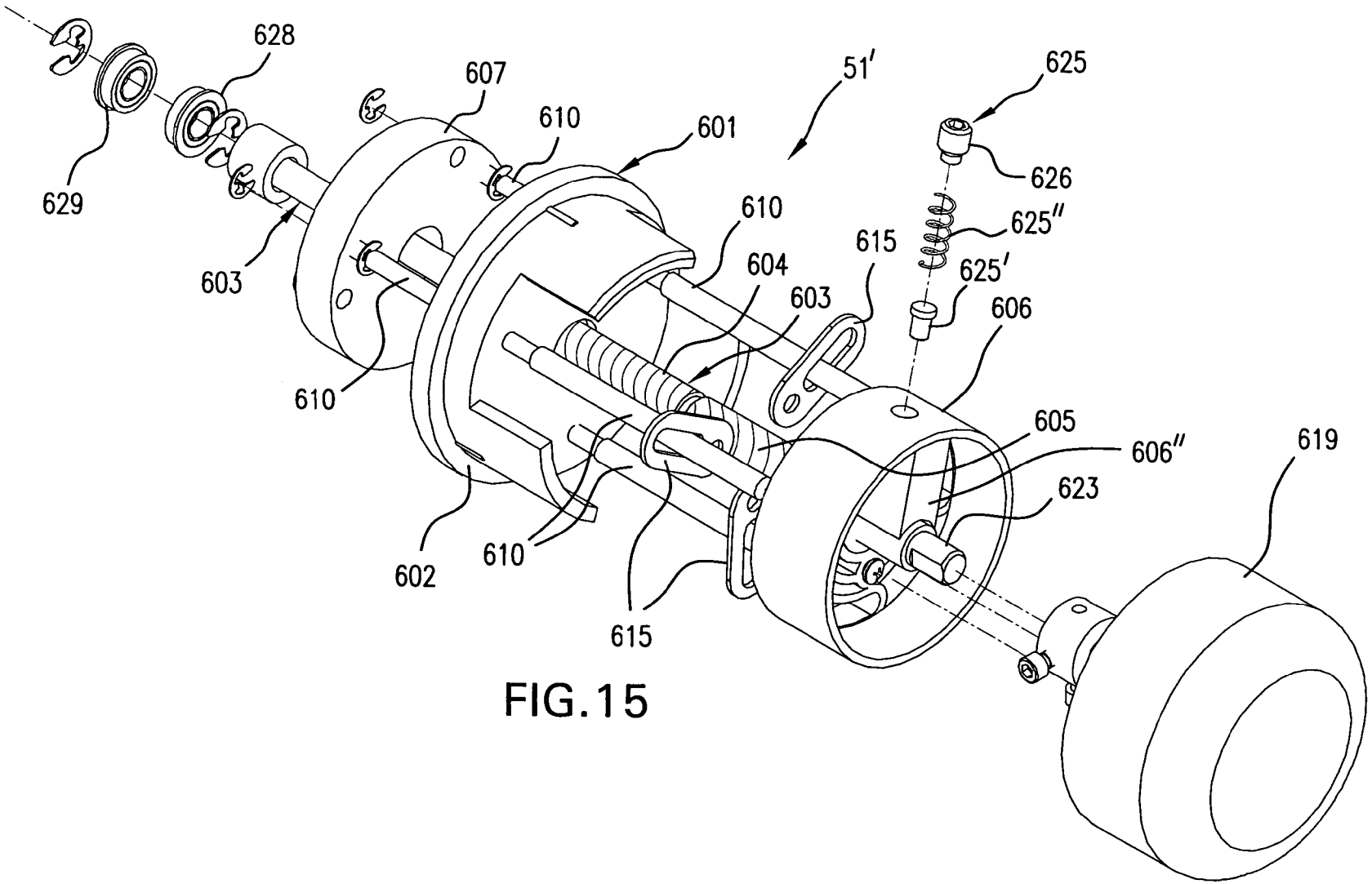
FIG. 15 is an exploded pictorial view of the take-up roll rewind.
Figure 16:
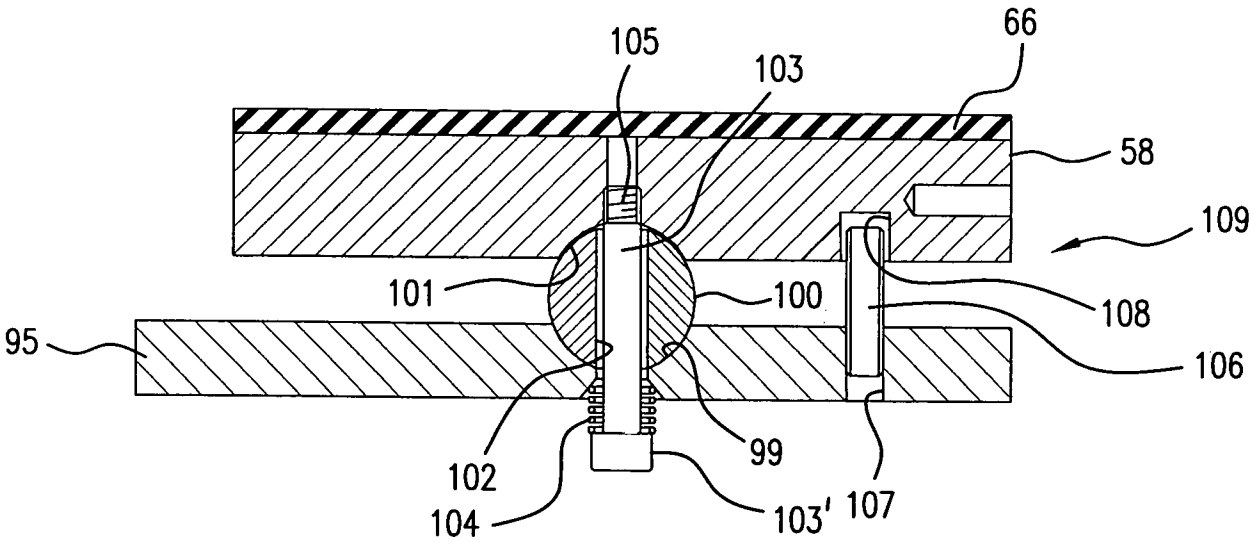
FIG. 16 is a cross-sectional view through a lower platen assembly.

With reference to FIGS. 14 and 15 there is shown the motorized supply roll rewind 51. The rewind 51 includes a take-up roll holder 51'. The rewind 51 may be the same as the unwind disclosed in co-pending U.S. patent application Ser. No. 11/409,804 filed Apr. 14, 2006, the disclosure of which is incorporated herein in its entirety. With respect to the rewind 51, the same reference characters are used as in patent application Ser. No. 11/409,804 for ease of reference. The rewind 51 includes a shaft 603 with a left-hand threaded portion 604 and a right-hand threaded portion 605. A handle or knob 619 is secured to end portion 623 of the shaft 603. A carrier 606 threadably receives the threaded portion 605, and a hub 601 with a flange 602 threadably receives the threaded portion 604. Rods 610 are secured to a mounting block 607. The hub 601 makes a sliding fit with the rods 610. There is a clamp member 615 on each rod 610. The rods 610 pass through elongate slots 616 in the clamp members 615 and the clamp members 615 are pivotably mounted on the carrier 606. The shaft 603 is rotatably mounted in bearings 628 and 629. A brake 625 includes a set screw 626 bearing on a compression spring 625" which bears on a plunger 625' all mounted in an internal block 606" in the carrier 606. The brake 625 applies a slight braking force to the shaft 603. The core C' of the roll R' is positioned against a flange 602 on the hub 601. Because the clamp members 615 are retracted, the core C' can be slid onto the hub 601. When the knob 619 is rotated clockwise, the clamp members 615 move to their extended positions, and with continued clockwise rotation of the knob 619, the clamp members 615 and the hub 601 move toward each other in unison to center-justify the take-up roll R' with respect to the centerline of the platens 57 and 58. To unload the take-up roll R' the knob 619 is moved counterclockwise which results in retraction of the clamp members 615 so that the core C' with its spent carrier web W can be removed from the rewind 51.

With reference to FIG. 14, the take-up roll or rewind holder 51' is shown to be driven by a stepping motor 211 through gearing 210' shown in greater detail in application Ser. No. 11/409,804. The bearing 629 is mounted in an opening 629' of a bracket 634'. The bracket 634' is secured to panels 48*b* and 48*d* by screws 634".

The guides 61 and 65 are secured to panel 48*d* by screws 61'. The roll 64 is rotatably mounted in bearings 64' which are mounted in turn in the panel 48*a* and a standoff 64". A DC motor controller circuit board 137' for the motor 137 is mounted in the side portion 47. Except for circuit board 137', the motor 211, the plate 634', gearing 210', bearings 64' and 627, and standoff 64" shown in FIG. 14, the side portion 47 is hollow.

The DC motor 137 of the unwind 50 is preferably energized at a constant energy level to urge the supply roll R in a first rotational direction with a first force, although it is contemplated that the PLC can adjust or be adjusted to vary the energy level, if desired. The motor 137 urges the unwind holder 50' clockwise in FIG. 1 which causes the composite web CW and its carrier web W to be under a predetermined amount of tension. The amount of tension is sufficient not only to keep the carrier web W tensioned, but after completion of the application of the transfer T to the transfer-receptive material G and while the platen 57 is returning to the home position, the motor 137 can move the supply roll holder 50' and the roll R clockwise (FIG. 1) to take up slack in the section of composite web CW between the roll R and the platen 57. On the other hand, the stepping motor 211 of the rewind 51 maintains or holds the take-up roll holder 51 and the take-up roll R' in a stationary position (by energizing the motor windings as is known in the stepping motor art) at all times except when the carrier web W is to be advanced. The stepping motor 211 is energized to advance the take-up roll holder 51' and the take-up roll R' only after completion of a transfer-applying cycle, and this causes additional length of carrier web W to be pulled with a second force greater than the first force and to be wound onto the roll R' to bring the next transfer T into transfer-applying position with respect to and between the platens 57 and 58. In FIG. 1, the web W is shown to pass from the guide 64 to the top of the roll R'. In rewinding the web W, therefore, the take-up roll R' is driven clockwise by the motor 211. If, however, the web W is wound so that it would pass to the bottom of the roll R', the roll R' would be driven counterclockwise by the motor 211. The first force mentioned above is insufficient to change the position of the take-up roll R'. It is preferred to allow a short time interval to occur between the time the platen 57 is in transfer-applying relationship with respect to the transfer T and the time the platen 57 has moved upwardly at least sufficient to clear the carrier web W. It is during this upward movement of the platen 57 that the supply roll holder 50' can be moved clockwise (FIG. 1) by the motor 137 to maintain tension in the entire carrier web W between the roll R and the roll R'. If slack were to develop in that portion the composite web CW between the platen 57 and the roll R, as the platen 57 moves upwardly, that slack is immediately taken up by the motor-driven holder 50', thereby causing that portion of the composite web CW to move opposite the travel direction P. The force applied to the composite web roll R by the motor 137 is large enough to maintain tension at all times but the tension force is not so great as to distort the transfers T of the composite web CW. However, when the motor 211 of the rewind 51 is energized to advance the carrier web W, the force exerted on the composite web W by the motor 211 is greater than and overcomes the tensioning force applied to the composite web CW by the motor 137. Accordingly, the carrier web W can be advanced because the force to advance the carrier web W is greater than the force to tension the carrier web W. Nevertheless, the force exerted by the motor 211 on the carrier web is not so great as to adversely affect the transfers T carried by the carrier web W. The energy level applied to the motor 211 to advance the carrier web W is preferably constant, although the energy level can be adjusted, if desired. For example, the energy level may be ramped up so as to provide a more gradual force increase. In order to apply a transfer T to for example a garment, the user places the garment on the platen 58 and operates the two hands switches S1 and S2 to initiate a transfer-applying cycle. The platen 57 translates from a home or first position to a transfer-applying or second position, and this translation causes the composite web CW to be unwound from the supply roll R.

Figure 17:
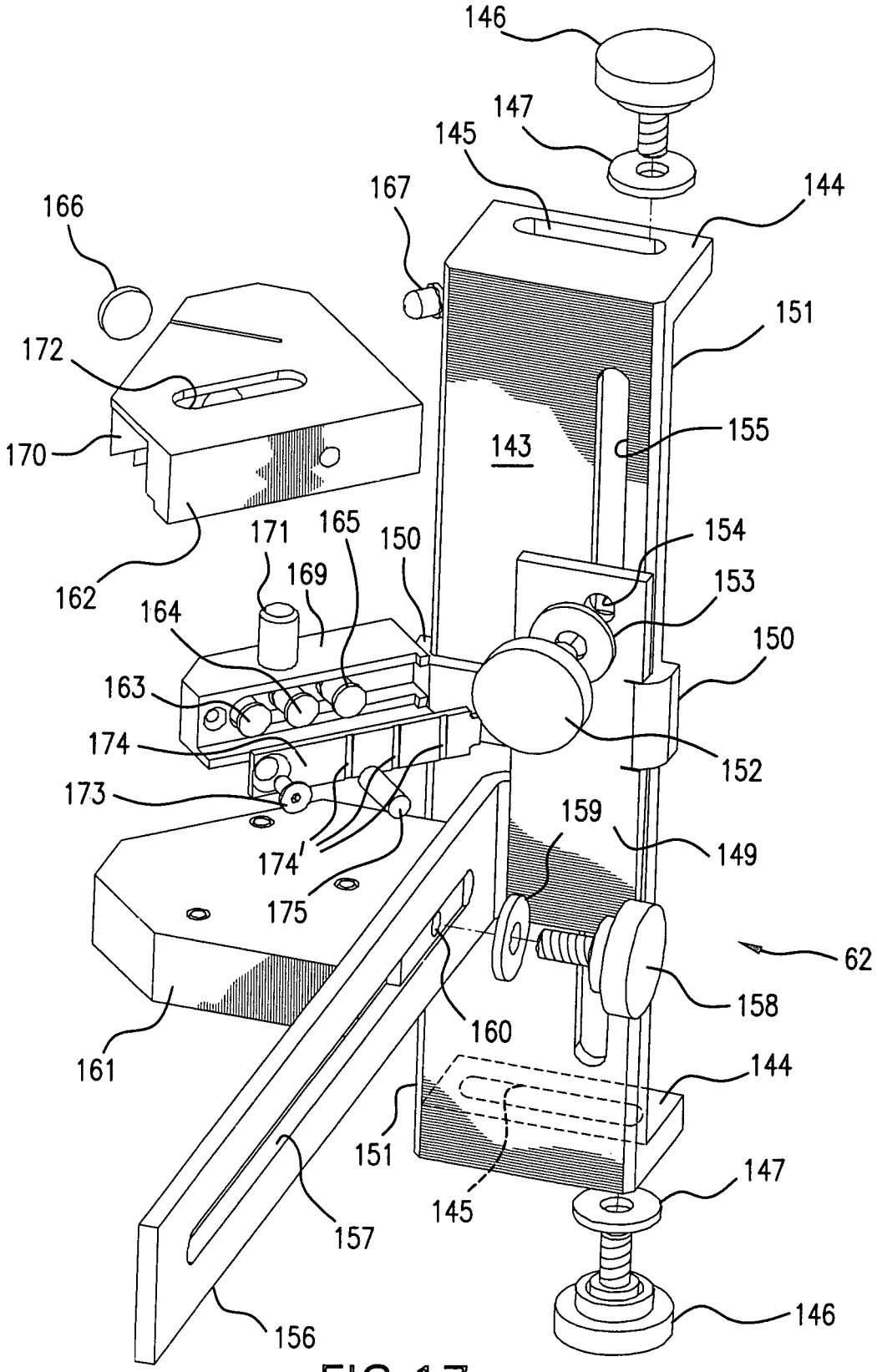
FIG. 17 is a pictorial view of a sensor assembly.
Figure 19:
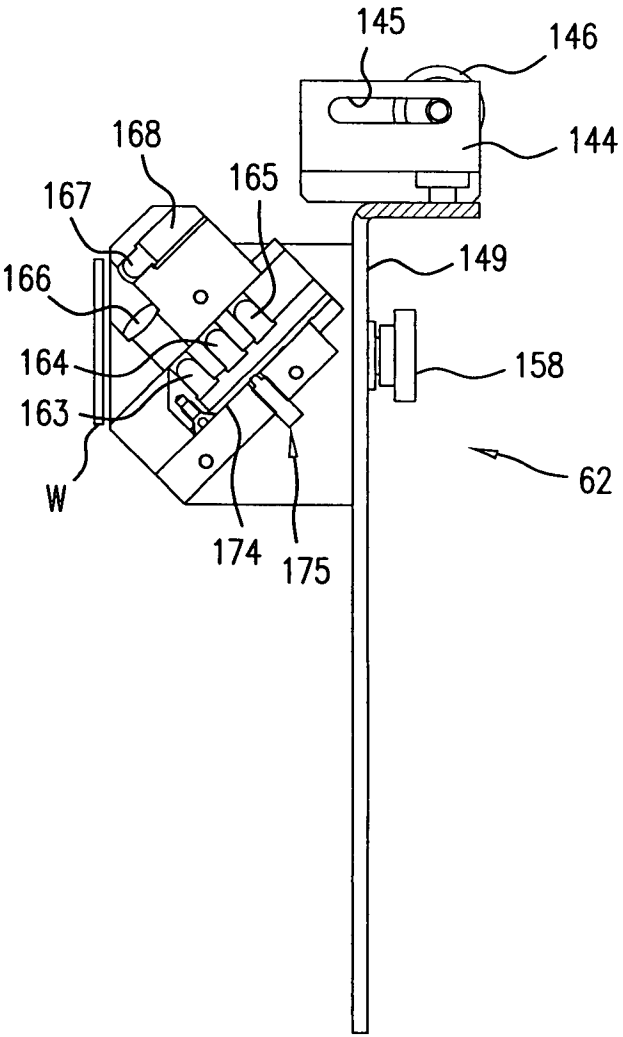
FIG. 19 is a fragmentary top plan view of the sensor assembly.
Figure 18:
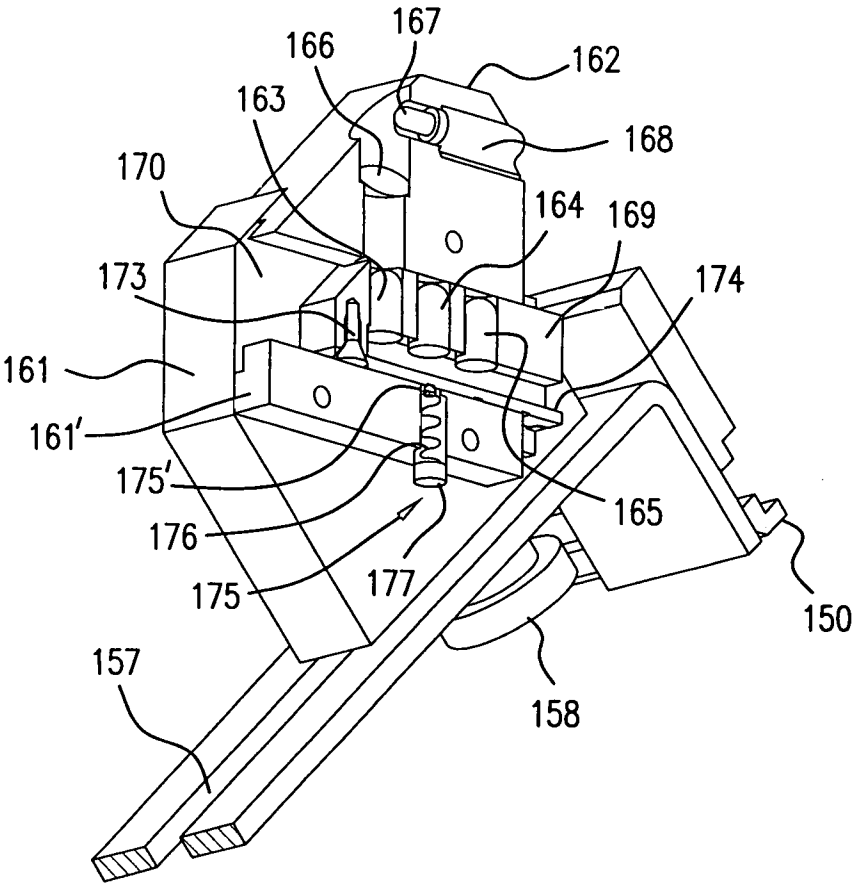
FIG. 18 is a fragmentary pictorial view of the sensor assembly.
Figure 20:
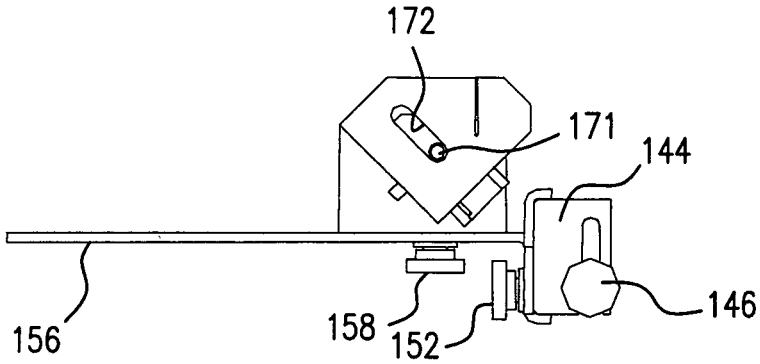
FIG. 20 is a top plan view of the sensor assembly.
Figure 21:
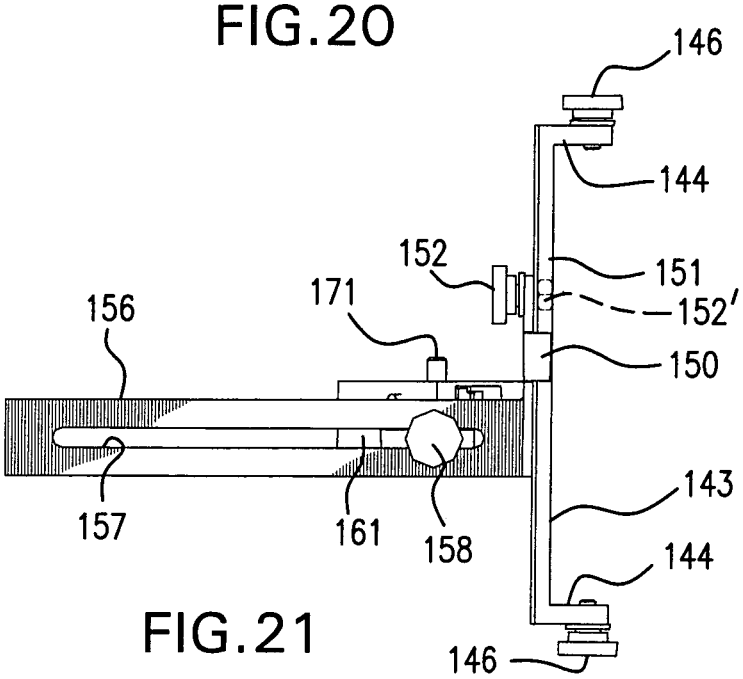
FIG. 21 is a side elevational view of the sensor assembly.

After the transfer T has been applied, the piston 54 is driven upward and carries along the upper platen 57 to the home or first position. It is preferred that the platen 57 be in the home position at which time PLC causes the motor 211 to advance the carrier web W. The registration marks 63 are sensed by a sensor 167 (FIGS. 17-19). When a mark 63 is sensed by the sensor 167, the PLC causes interruption of the advance of the carrier W by the motor 211 and the PLC thereupon returns the motor 211 to the stationary or locked condition in which the shaft 603 of the rewind 51 is unable to rotate. The applicator 40 is now ready for the next cycle in which a transfer T can be applied. Accordingly, the advance of the carrier web W is intermittent and is considered to preferably follow the transfer-applying cycle. In that the advance is intermittent, the web W is considered to be alternately held stationary and fed.

Figure 11:
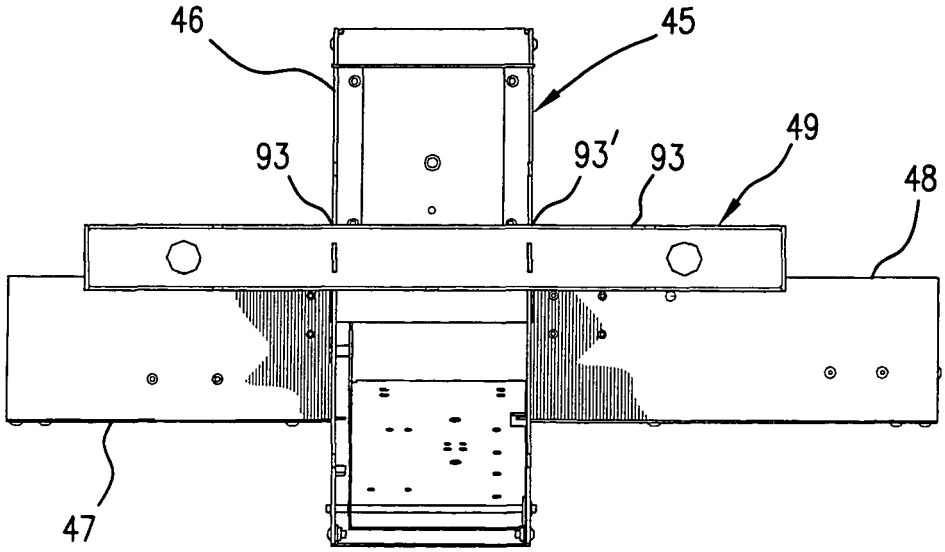
FIG. 11 is a bottom plan view of the support.

With reference to FIGS. 17 through 21 and initially to FIG. 17, there is shown the sensor assembly 62, having a bracket 143 with upper and lower flanges 144 having slots 145. Thumb screws 146 pass through washers 147 and the slots 145 and are threadably received by the panels 48*d* and 48*e* in threaded holes 148 (FIGS. 11 and 14). By loosening the thumb screws 146 the bracket 143 can be slid horizontally and upon tightening the entire assembly 62 can be moved as a unit toward and away from the carrier web W (FIG. 19). The bracket 143 mounts another bracket 149 with sides 150 that embrace side edges 151 of the bracket 143. A thumb screw 152 passes through a washer 153, through a hole 154 in the bracket 149, through an elongate-vertical slot 155 in the bracket 143 and into a nut 152' on the far side of the bracket 143. The bracket 149 includes a horizontal arm 156 with an elongate horizontal slot 157. A thumb screw 158 passes through a washer 159 and the slot 157 and is threadably received in a threaded hole 160 in a mounting block 161. By loosening the thumb screw 158 the mounting block 161 can be slid horizontal laterally of the carrier web W as shown in FIG. 19.

A sensor subassembly 162 is secured to the mounting block 161. The subassembly 162 mounts a plurality of light sources, such as light emitting diodes (LED), or in the form of bulbs, 163, 164 and 165. The light bulb 163 can be red, the light bulb 164 can be green and the light bulb 164 can be blue, but the order in which they are arranged is a matter of choice. The light bulb 163 is shown to be aligned with a lens 166 in FIGS. 18 and 19. The lens 166 focuses light from the bulb 163, for example, on the carrier web W to illuminate the registration marks 63. Light reflected from the web W is sensed by a sensor 167 (FIGS. 17 and 19) which fits into a bore 168. A bulb holder 169 mounts the bulbs 163, 164 and 165. The holder 169 is slidable in an undercut channel 170. A stud 272 on the holder 169 projects through an elongate slot 172 in the sensor subassembly 162. Secured to the rear side of the holder 169 by a screw 173 is a detent strip 174 with three spaced parallel grooves 174'. The grooves 174' correspond in spacing to the spacing of the bulbs 163, 164 and 165. A detent generally indicated at 175 mounted in a bracket 161' secured to the mounting block 161 includes a plunger 175 cooperable with any one of the grooves 174'. The plunger 175' is urged by a compression spring 176 backed by a set screw 177. The entire holder 169 can be slid in the channel 170 so that any one of the bulbs 163, 164 or 165 can be aligned with the lens 166. The detent 175 cooperating with any groove 174' releasably holds the selected light bulb 163, 164 or 165 aligned with the lens 166. As viewed in FIG. 19, by loosening the thumb screw 146, the entire sensor assembly 62 can be moved toward or away from the carrier web W in a horizontal plane. By loosening the thumb screw 152 the sensor 166 and the light bulbs 163, 164 and 165 can be moved in a vertical plane at right angles to the above-mentioned horizontal plane in which the entire sensor assembly 62 moves, that is, longitudinally of the carrier web W. By loosening the thumb screw 158 the sensor 166 and the light bulbs 163, 164 and 165 can be moved laterally of the carrier web W in a different horizontal plane. The bulbs 163, 164, and 165 can be selectively or simultaneously energized, however, only light from the bulb which is aligned with the lens 166 will reach the carrier web W. A plurality of light sources may be provided because it frequently happens that the registration marks 63 are of various colors other than black. In an alternative embodiment, a single bulb that is capable of providing multiple colors may be used and the color may be selected during start. If multiple colors are available, in an embodiment the user can select the color which provides the best response. In this way, the sensor 166 is able to sense the registration marks 63 even if registration marks 63 are of colors other than black.

Figure 23:
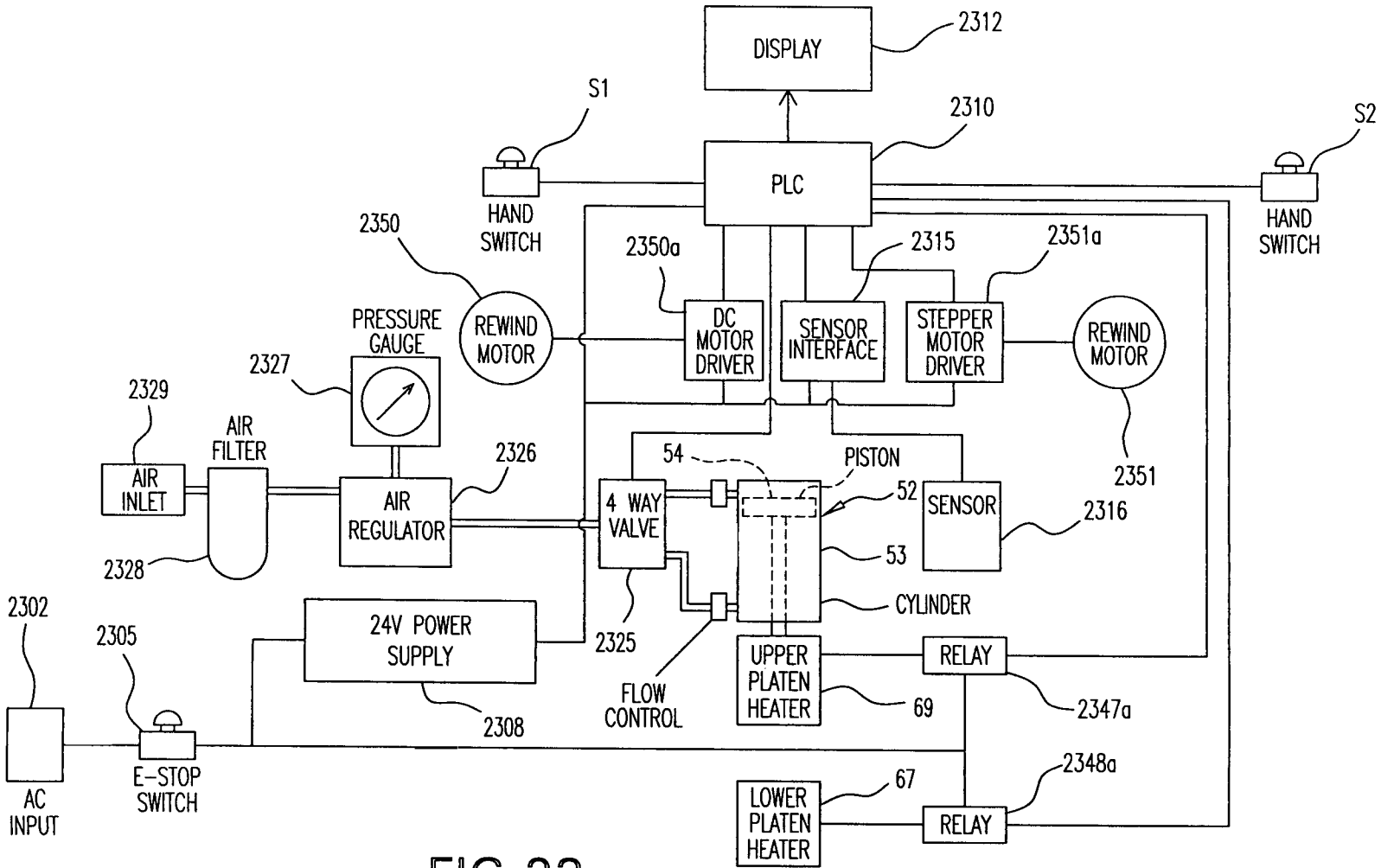
FIG. 23 is a block diagram showing electrical and fluidic components for the applicator.

Looking now at FIG. 23, a schematic representation of an illustrative embodiment of an applicator is depicted. While greater details of an illustrative embodiment were discussed above, in general a rewind motor 2350, such as the DC motor 137, is provided to urge a supply roll R in a first angular direction. The angular force exerted on the supply roll R causes, it to take up slack and roll the web W onto the supply roll R. The web W extends from the supply roll R to a take-up roll R' and may travel over one or more rollers that allows the path of the web W to be redirected appropriately. The path of the web W also passes between the upper platen 57 and the lower platen 58, thus the rewind motor 2350 urges the web in a first direction with respect to the upper and lower platen 57, 58. The take-up roll R' is driven by a rewind motor 2351, such as the stepper motor 211 discussed above, which when activated causes the take-up roll R' to rotate in a second angular direction. The angular movement of the take-up roll R' causes the web W to be rolled onto the take-up roll R' and therefore directs the web W in a second direction with respect to the upper platen 57 and the lower platen 58, the second direction being the opposite of the first direction. Thus, as discussed above, the rewind motor 2350 aids in keeping the web W in a desirable tension while the rewind motor 2351 may be used to advance the web W. It should be noted that the position of the two rewind motors can be varied as desired and the direction that the rewind motors 2350 and 2351 move the web W can vary, depending on the desired configuration of the applicator 40. For example, both rewind motors may turn the rolls R and R' in the same direction so that the side of the web W with the transfer(s) is wrapped on the inside of the take-up roll R' (e.g., the first and second angular directions are the same).

To control the movement of the rewind motors 2350, 2351 (which in turn controls the tension and position of the web W), a controller, such as PLC 2310, may be used to control a DC motor driver 2350*a* and a stepper motor driver 2351*a*, respectively. The PLC 2310, of which an embodiment will be discussed in greater detail below with respect to FIG. 22, can distribute power received from a power supply, such as 24 volt power supply 2308. The power supply 2308, which as depicted converts AC power to DC power, receives the AC power from AC input 2302 and the power may be routed through an emergency stop switch 2305 so that electrical power to the system can be quickly shut-off if so desired.

It should be noted that while the PLC 2310 provides certain benefits such as the ability to readily change certain parameters, other types of controllers may be used. In general, controllers are known and the functionality of a controller may be provided by logical processors through the use of programming instructions provided in memory—thus a general purpose computing device appropriately coupled to a number of relays could also provide the desired functionality. While programmable controllers such as the PLC 2310 are commonly used in controlling systems, other less programmable logic controllers may also be used.

As discussed above, the applicator 40 may include the heater 69 in the upper platen 57 and/or the heater 67 the lower platen 58. In an embodiment, the heaters 69 and/or 67 receive power directly from the AC input 2302 but the power delivery from the AC input 2302 is modulate by relays 2347 and 2348, which are controlled based on signals received from the PLC 2310. In an embodiment, the temperature of the heaters 67, 69 (if provided) may be monitored with a sensor so that the PLC can control the temperature of each platen in a desired manner. As can be appreciated, any desirable sensor may be used to detect the temperature and provide feedback to the PLC, including sensors that measure the temperature of the platen directly as well as sensors that measure the temperature of the heater. Alternatively, the heater may be a constant temperature heater and in such a system the heater could simply be turned on or off without the need for close-loop control.

To control the position of the upper platen 57, a piston 54 actuated by changes in pressure, such as discussed above, may be used. Naturally, other mechanisms such as electrical motors with suitable translation mechanisms such as a worm drive could also be used but, as illustrated in FIG. 23, a pneumatic system with piston 54 positioned in a cylinder 53 is a suitable configuration. To minimize complexity, the piston 54 may be positioned through the use of a 4-way valve 2325 that directs pressurized gas below or above the piston in response to signals received from the PLC 2310, causing the piston 54 to move up and down, respectively. The 4-way valve may receive the pressurized air from a regulator 2326 that includes a pressure detector, such as gauge 2327 which may be used to provide visual feedback to the operator. To protect the internal components, an air inlet 2329 (which provides the pressurized gas) may direct the pressurized gas through an air filter 2328 so that shop air may be used, if desired, rather than requiring a separate air source.

In operation, the PLC 2310 can provide signals to the DC motor driver 2350*a*, the stepper motor driver 2351*a* and the 4-way valve 2325 in response to a status of safety devices such as hand switches S1 and S2. For example, the PLC 2310 can prevent the applicator 40 from cycling unless the operator's has pressed both switches S1 and S2 within a predetermined time period. The PLC 2310 can detect the timely actuation of the switches S1 and S2 based on status of a first and second circuit, which include the switches S1 and S2, respectively.

The PLC may also control actuation of the stepper motor 2351*a* based on signals received from a sensor module 2316, which may be the sensor subassembly 162 discussed above. Generally, the sensor module 2316 will be configured to provide feedback to the PLC 2310 so that the PLC can determine when the web W has been advanced a sufficient distance. This may include a signal representing that the web W has translated a standard distance (so as to allow the PLC to count the number of intervals and determine when to cease providing a signal to the stepper motor driver 2351*a*) or that the web W has been advanced to the next operating position.

Figure 22:
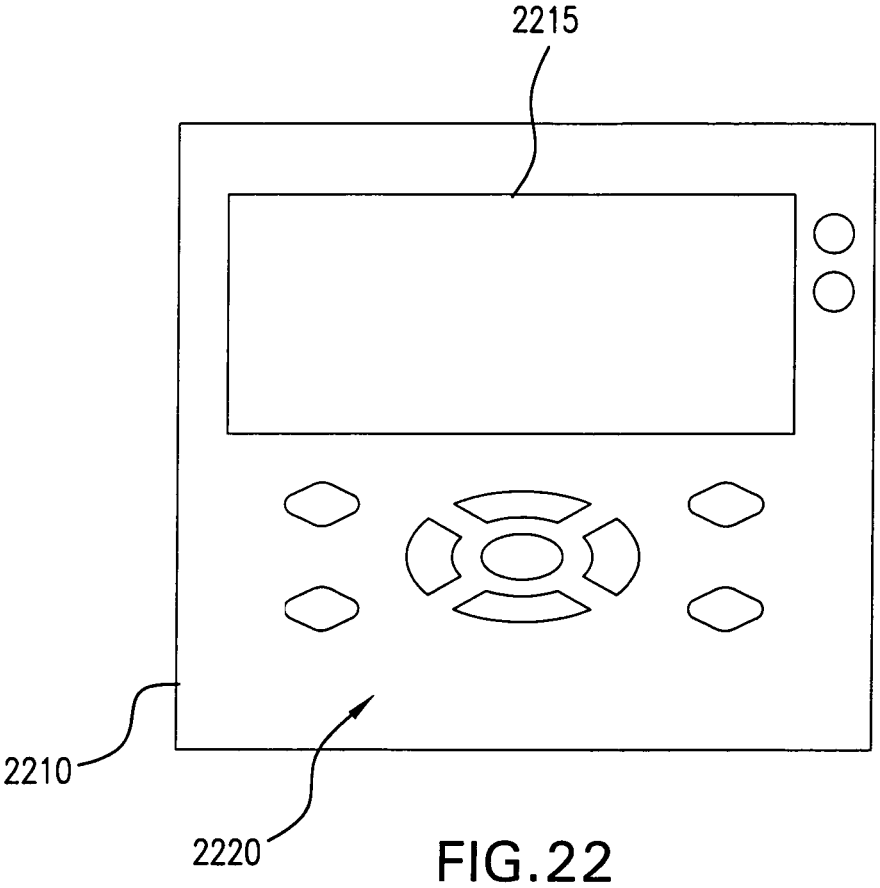
FIG. 22 is a front elevational view of a control panel.

The PLC 2310, which may be a model MFD-80-B-265251 with a model MFD-CP8-ME power supply/CPU and a model MFD-TA17-265256 expansion unit to provide addition inputs/outputs (provided by Moeller), receives the inputs and provides outputs based on the desired functionality and programming. In an embodiment, the PLC 2310 may include a housing 2210 with a display 2215 and a user input panel 2220 as depicted in FIG. 22. The display 2215 may indicate the status of the applicator 40 (such as ready or warming up) as well as a number of operating cycles performed by the applicator 40. In an embodiment, two values can be provided, a lifetime number of cycles and a number of cycles during a current period. The display 2215 can also display various settings (such as temperature or dwell time) so that a user can use the user input panel 2220 to select and adjust various settings such as lengths of various timers, values of temperature settings (if an adjustable temperature features is provided to heat one or more of the platens) and to reset certain parameters such as the number of cycles during the period. The user input panel 2220 may also be used to turn certain features (such as heating the lower platen 58) on or off. Thus, the PLC 2310, if so configured, can allow a user the ability to change a number of parameters so as to allow the applicator 40 to be compatible with a variety of materials and/or webs CW without the need to reprogram the PLC 2310.

Figure 24:
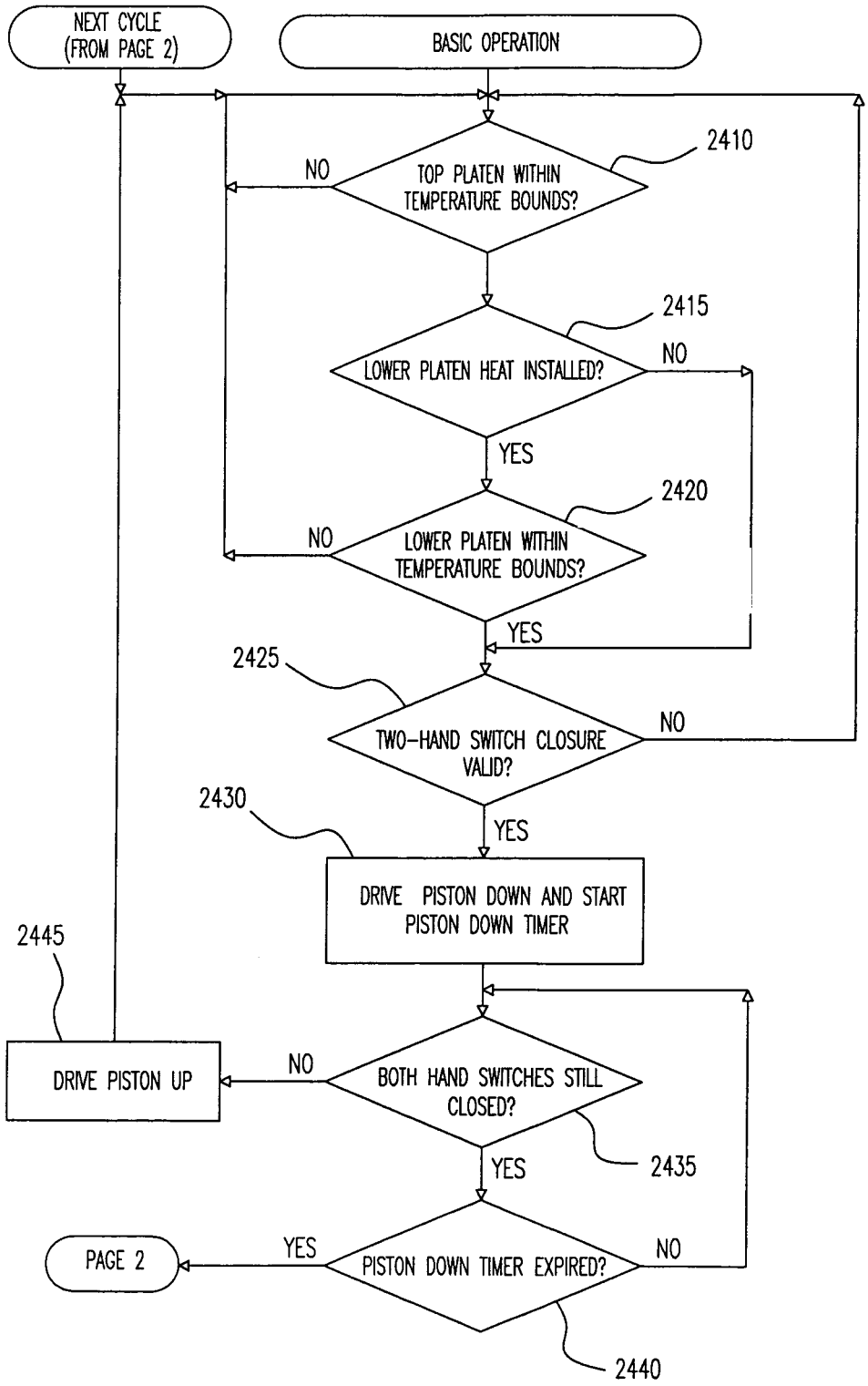
FIGS. 24 and 25 are flow charts.
Figure 25:
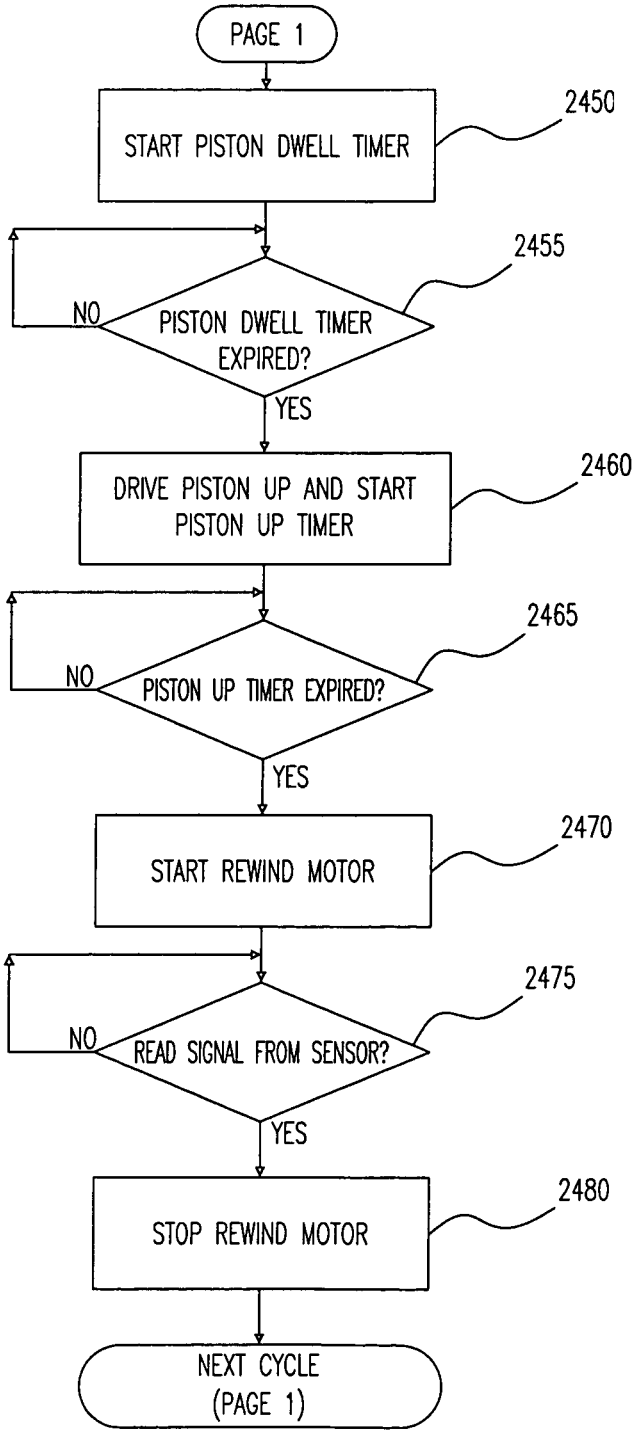

Turning to FIGS. 24 and 25, a flowchart illustrating a possible operation of the applicator 40 is depicted. It should be noted that steps may be added or removed, as appropriate, and that the order of the steps may be adjusted. Furthermore, as will be discussed, variations of certain steps are possible, depending on the desired configuration of the applicator 40.

Once the system settings are programmed, upon activation of the applicator 40 (which may comprise turning on the PLC 2310) a basic operation of the applicator 40 may begin. In step 2410, a first check is made to determine whether the upper platen 57 is at the appropriate temperature. If the upper platen 57 is not properly heated, this step is repeated. Once the upper platen 57 temperature is within operational parameters, a check is made to see whether lower platen heater is installed in step 2415. If it is, then in step 2420 a check is made to see whether the lower platen is within operational parameters. If not, then steps 2410 may be repeated.

As can be appreciated, while more applications will likely use some heat, it is also possible to work without heating either platen, and in such a case the temperature checks could be omitted. Furthermore, the check in 2415 could also be to determine whether the lower heater 67 for the lower platen 58 was being used, rather than whether it is installed. In addition, the operation temperature of the lower platen 58 could be set low enough so that the lower platen heater 67 never comes on and step 2415 could be omitted and the check as to whether the lower platen 58 was within the temperature boundary would be yes. It should be noted that the check in 2410 (and 2420 if made) can be a determination that the temperature is within a range with an upper and a lower boundary so as to prevent both overheating and under heating of either platen.

Next, in step 2425, a check is made to see whether the operator switches (such as switches S1 and S2 of FIG. 23) were properly actuated. This may include a determination that the two switches were closed within a predetermined time period (so as to prevent an operator from placing something on one of the switches and just actuating the other switch). Then, in step 2430, the 4-way valve 2325 is actuated so as to drive the piston 54 down and a down timer is started. As can be appreciated, the ability to adjust the down timer allows for variation in the setup (such as variations in pressure being received from the air inlet 2329).

As discussed, the translating of the upper platen 57 down places tension on the web W which is sufficient to overcome the force being exerted by the rewind motor 2350, thus it is the pressing down of the upper platen 57 that causes the web W to advance next position. As can be appreciated, this helps protect the transfer(s) on the web W from exposure to heat from the upper platen 57 (if it is heated) until it is time to apply the transfer(s). Thus, as depicted, the transfer(s) that is/are about to be applied is/are moved into position concurrently with the downward movement of the upper platen 57. While it is contemplated that a single level of force can be exerted by the rewind motor 2350, in an embodiment the level of force can be adjusted, for example reduced, as the upper platen 57 begins to move down. The period that reduced force is provided can be less than the time it takes for the upper platen 57 to move down so that the web W is allowed to advance more readily while still ensuring a proper tension on the web W before it is pressed against, for example, a garment.

In step 2435, a check is made to verify that the safety switches S1 and S2 are being depressed by the user. If one or both of the switches are not depressed, then in step 2445, the piston 54 is raised and step 2410 is repeated. If the switches are still actuated, then in step 2440 a check is made to see whether the down timer has expired. If is has not, then step 2435 is repeated. If the down timer has expired, then in step 2450, the piston dwell timer is started. As noted above, this timer can be adjusted to compensate for the particular application and the design of the web W.

Next in step 2455, a repeating check is made to see if the dwell timer has expired. Once the dwell timer has expired, in step 2460, the piston 54 begins to be driven up and a piston up timer is started. In step 2465, a repeating check is made to see if the up timer has expired. When the up timer expires, in step 2470, the rewind motor 2351 is actuated. In an embodiment, this can be accomplished by providing a signal to the stepper motor driver 2351*a*. In step 2475, a check is made as to whether a signal indicating the web W has reached the next position has been received from the sensor module 2316. Once the signal is received, in step 2480 the rewind motor is stopped (by sending another signal to the stepper motor driver, for example), a cycle is complete (and a counter may be incremented) and step 2410 is repeated.

As can be appreciated, step 2475 is based on a configuration that provides a signal when the web W has reached the next position rather than providing a signal each time the web W has moved a particular distance. While either method can work, an advantage of the depicted method is that there is no need to program the PLC 2310 based on the distance needed. Thus, it is a simple matter to replace the web W with a different web W' that has a different sized graphic being applied so long as each web W uses the appropriate marking scheme.

As can be appreciated based on the depicted diagrams and illustrations, variations are possible. For example, one or more sensors could be used to indicate that the platen had reached the down position and the up position rather than rely on timers. Furthermore, if an electrical motor was used to position the upper platen 57, the position of the upper platen 57 could be determined based on feedback received from the electrical motor.

By way of example, not limitation, the entire applicator 40 may be configured as discussed above so that it weighs about 60 pounds, the support 45 weighs about 32 pounds, the upstanding position 46 weighs about 25 pounds, the support portion 47 weighs about 3 pounds, and the support portion 48 weighs about 4 pounds. The portable applicator 40 preferably weighs less than 100 pounds and most preferably between 60 or less and 100 pounds. The support 45 preferably weighs less than 50 pounds. Each side portion preferably weighs less than 10 pounds and most preferably less than 5 pounds. The overall dimensions of the applicator 40 from side-to-side may be about 24.2 inches, the overall height of the applicator 40 may be about 19 inches, and the overall depth of the applicator from front-to-back may be about 14.5 inches. The center-to-center distance between the supply roll shaft and the rewind shaft may be about 20 inches. The depth of the upstanding portion 46 at the base 46' may be about 12.56 inches and the overall length of the stabilizer 49 may be about 18.2 inches. Thus, in an embodiment, the applicator 40 can have a volume, considering the height of the upstanding position 46, the width from the left side of the supply roll holder 50' to the panel 48*b*, and the depth of the applicator 40, of about 3.86 cubic feet. So, therefore, an embodiment of the applicator 40 will fit into a shipping carton having an internal dimension of about 24 inches by 19 inches by 14.5 inches and a volume of about 3.86 cubic feet.

Other embodiments and modifications of the invention will suggest themselves to those skilled in the art, and all such of these as come within the spirit of this invention are included within its scope as best defined by the appended claims.

We claim:

The invention claimed is:

1. An applicator, comprising:

a first platen and a second platen movable relative to each other;

an actuator connected to the first platen, said actuator operative to selectively move the first platen toward the second platen and away from the second platen;

a supply roll unwind for holding a supply roll of a composite web comprised of a carrier web and a plurality of transfers releasably adhered to the carrier web;

a take-up roll rewind for accumulating the carrier web onto a take-up roll, wherein as the composite web is unwound from the supply roll it moves in a travel direction to pass between the first and second platens where the transfers are selectively removed from the carrier web which continues onto the take-up roll; and, a first motor that applies rotational force to the supply roll in a wind direction while the composite web is being unwound from the supply roll, thereby exerting force on the composite web opposite to the travel direction.

2. The applicator of claim 1, further comprising:

a second motor that drives the take-up roll intermittently in a wind direction to wind spent carrier web onto the take-up roll.

3. An applicator, comprising:

a support, a driven applicator platen on the support, the platen being capable of being heated, a driver connected to the platen, said driver operable to selectively move the platen in a first direction and a second direction opposite the first direction, a supply roll unwind on the support and capable of holding a supply roll of a composite web comprised of a carrier web and a plurality of transfers releasable adhered to the carrier web, the unwind being motor-driven continuously in a winding direction to tension the composite web, and a take-up roll rewind on the support to accumulate spent carrier web onto a take-up roll, the carrier web being movable in a travel direction with the composite web being unwound from the supply roll to pass into transfer-applying relationship with the applicator platen and onto the take-up roll, and the take-up roll being driven by the rewind only when required to advance the spent carrier web onto the take-up roll.

4. An applicator as defined in claim 3, including a sensor to sense registration marks on the carrier web, and a plurality guides enabling threading of the carrier web to selectively sense registration marks on either one of opposite faces of the carrier web.

5. An applicator as defined in claim 3, including a web registration sensing assembly having a holder, a plurality of different color light sources mounted on the holder and capable of illuminating a longitudinally extending moving web having registration marks of a plurality of different colors, a sensor capable of receiving light from anyone of the light sources to sense a registration mark, and the holder being adjustable transversely and longitudinally of the web to selectively illuminate the web with at least one of the light sources.

6. An applicator as defined in claim 3, the support including a support plate, a supporting platen capable of supporting transfer-receptive material and spaced from the support plate, and a ball between the support plate and the supporting platen to enable the supporting platen to accommodate variations during cooperation with the driven applicator platen.

7. An applicator as defined in claim 3, including two hand-operated switches on the support, wherein one switch is disposed to one side of the platen and the other switch is disposed on the other side of the platen, and a control to enable movement of the platen into transfer-applying relationship only when both switches are operated within a predetermined time period.

8. An applicator, comprising:

a support, an actuator mounted on the support, an applicator platen movable by the actuator between a raised home position and a lowered transfer-applying position, a supply roll unwind on the support and capable of holding a supply roll of a composite web comprised of a carrier web and a series of transfers releasably adhered to the carrier web, the composite web being capable of being drawn from the supply roll to pass to beneath the applicator platen in its home position, the unwind including a motor to drive the supply roll continuously in a wind direction to exert continuous tension on the composite web, and wherein the actuator is actuatable to cause the applicator platen to move toward the transfer-applying position and draw composite web from the supply roll.

9. An applicator as defined in claim 8, including a take-up roll rewind on the support to accumulate spent carrier web onto a take-up roll, and the rewind having a motor to alternately hold the spent carrier web from movement and to wind spent carrier web onto the take-up roll following application of a transfer.

10. An applicator as defined in claim 9, wherein the take-up roll rewind center-justifies the spent carrier web with respect to the centerline of the platen.

11. An applicator, comprising:

a support, a first platen and a second platen on the support and movable relative to each other, at least one of the first and second platens being heatable and at least one of the first and second platens being capable of supporting transfer-receptive material, an actuator connected to the first platen, said actuator operative to selectively move the first platen toward the second platen and away from the second platen, a supply roll unwind on the support and capable of holding a supply roll of a composite web comprised of a carrier web and a plurality of transfers releasable adhered to the carrier web, a take-up roll rewind on the support to accumulate spent carrier web onto a take-up roll, the carrier web being movable in a travel direction and with the composite web being unwound from the supply roll to pass between the first and second platens and onto the take-up roll, the unwind having a motor to drive the supply roll continuously in a wind direction to exert force on the composite web opposite to the travel direction, the rewind having a motor to drive the take-up roll intermittently in a wind direction to wind spent carrier web onto the take-up roll, and wherein movement of at least one of the platens against the composite web overcomes the force exerted by the unwind to draw composite web from the supply roll.

12. An applicator as defined in claim 11, the support having an upstanding portion and a pair of side portions.

13. An applicator as defined in claim 12, wherein the unwind is mounted on one side portion and the rewind is mounted on the other side portion.

14. An applicator as defined in claim 12, and an air motor mounted on the upstanding portion and coupled to the platen.

15. An applicator as defined in claim 13, and a piston-cylinder mechanism mounted on the upstanding portion and coupled to the platen.

16. An applicator as defined in claim 12, wherein each of the upstanding portions and the side portions is constructed essentially solely of sheet metal.

17. An applicator as defined in claim 12, and the upstanding portion having a lower portion, and a base member extending through the lower portion.

18. An applicator as defined in claim 11, the support including an upstanding portion, the upstanding portion having a pair of spaced sheet metal side panels generally shaped like the letter C, a generally horizontal plate connecting the side panels at the upper part of the C, a piston-cylinder mechanism having a cylinder mounted to the horizontal plate, and a piston operating in a cylinder, the first platen connected to the piston, and the second platen being at the lower part of the C and cooperable with the upper platen.

19. An applicator as defined in claim 18, wherein the support includes a support portion for a supply web roll attached to one side panel and another support portion for the web take-up roll, and wherein the support portions are comprised of sheet metal and are box-shaped.

20. An applicator as defined in claim 18, wherein the lower part of the C of each side panel has a cutout, and a sheet metal stabilizer extending through the side panels at the cutouts and outwardly of the side panels.

21. An applicator as defined in claim 18, and a sheet metal plate connecting the side panels.

22. An applicator as defined in claim 18, including a pivotally mounted access door spanning the space between the side panels.

23. An applicator as defined in claim 22, and including a pivotally mounted panel disposed between the side plates and accessible when the access door is opened.

24. An applicator as defined in claim 11, the support comprised essentially entirely of fabricated sheet metal and weighing less than 50 pounds, a supply roll holder on the support and capable of holding a supply roll of a composite web comprised of a plurality of transfers releasably adhered to a carrier web, and a take-up roll holder on the support to accumulate spent carrier web onto a take-up roll.

25. An applicator as defined in claim 11, the support having a central portion and side portions joining the central portion, a supply roll holder on the support and capable of holding a supply roll of a composite web comprised of a plurality of transfers releasably adhered to a carrier web, and a take-up roll holder on the support to accumulate spent carrier web onto a take-up roll.

26. An applicator as defined in claim 25, wherein the central portion and the side portions are in a generally T-shaped arrangement.

27. An applicator as defined in claim 25, wherein the applicator weighs less than 100 pounds.

28. An applicator as defined in claim 25, wherein the applicator weighs between about 60 or less and 100 pounds.

29. An applicator as defined in claim 25, wherein each side portion weighs less than 5 pounds.

30. An applicator as defined in claim 25, wherein each side portion weighs less than 10 pounds.

31. An applicator as defined in claim 25, wherein the support is fabricated essentially entirely of sheet metal.

32. An applicator as defined in claim 25, wherein the central portion and the side portions are box-shaped in construction and are comprised mainly of fabricated sheet metal.

33. An applicator as defined in claim 27, wherein the side portions are box-shaped, a motor disposed in one side portion to drive the supply roll holder, and a motor disposed in the other side portion to drive the take-up roll holder.

34. An applicator as defined in claim 11, including a holder mounted to the support, a plurality of different color light sources mounted on the holder and capable of illuminating a longitudinally extending moving web having registration marks of a plurality of different colors, a sensor capable of receiving light from more than one of the light sources to sense a registration mark, and the holder being adjustable to selectively illuminate the web with light from the light sources.

35. An applicator as defined in claim 34, wherein the holder is adjustable longitudinally and laterally of the web.

* * * * *